US008997271B2

(12) United States Patent
Bayley et al.

(10) Patent No.: US 8,997,271 B2
(45) Date of Patent: Apr. 7, 2015

(54) LAVATORY SYSTEM WITH HAND DRYER

(75) Inventors: Graeme S. Bayley, Brookfield, WI (US); Mark A. Figurski, Hartland, WI (US); Timothy E. Perrin, Hartford, WI (US); John M. Loberger, Germantown, WI (US); Jason M. Renner, Greenfield, WI (US); Kevin M. Kohlwey, Port Washington, WI (US); Jon A. Dommisse, West Bend, WI (US); Thomas E. Pelt, Menomonee Falls, WI (US)

(73) Assignee: Bradley Corporation, Menomonee Falls, WI (US)

( * ) Notice: Subject to any disclaimer, the term of this patent is extended or adjusted under 35 U.S.C. 154(b) by 451 days.

(21) Appl. No.: 13/122,368

(22) PCT Filed: Oct. 6, 2010

(86) PCT No.: PCT/US2010/051647

§ 371 (c)(1),
(2), (4) Date: Apr. 1, 2011

(87) PCT Pub. No.: WO2011/044247

PCT Pub. Date: Apr. 14, 2011

(65) Prior Publication Data

US 2011/0271441 A1 Nov. 10, 2011

Related U.S. Application Data

(60) Provisional application No. 61/278,487, filed on Oct. 7, 2009, provisional application No. 61/324,263, filed on Apr. 14, 2010.

(51) Int. Cl.

| | |
|---|---|
| ***E03C 1/18*** | (2006.01) |
| ***E03C 1/01*** | (2006.01) |
| ***A47K 10/48*** | (2006.01) |

(52) U.S. Cl.
CPC .. *E03C 1/01* (2013.01); *A47K 10/48* (2013.01)

(58) Field of Classification Search
CPC ..... A47K 2210/00
USPC ..... 4/619
See application file for complete search history.

(56) References Cited

U.S. PATENT DOCUMENTS

| | | | |
|---|---|---|---|
| 540,235 | A | 6/1895 | Clifford et al. |
| D30,136 | S | 2/1899 | Eckerson |

(Continued)

FOREIGN PATENT DOCUMENTS

| | | | |
|---|---|---|---|
| AT | 141398 | | 8/1996 |
| AU | 2005203363 | A1 | 2/2006 |

(Continued)

OTHER PUBLICATIONS

U.S. Appl. No. 29/306,946, filed Oct. 2, 2008, Thielke et al.

(Continued)

*Primary Examiner* — Janie Christiansen
(74) *Attorney, Agent, or Firm* — Boyle Fredrickson, S.C.

(57) ABSTRACT

A lavatory system including a countertop and a first hand washing station is provided. The first hand washing station includes a basin supported by the countertop and a faucet supported by the countertop. The lavatory system also includes a hand dryer including a housing supported by the countertop. The housing defines a cavity in which a user's hands are inserted during drying, and a motor configured to generate blown air which is supplied to the cavity. The housing is located such that the user's hands may be inserted into the cavity without the user leaving the first hand washing station.

28 Claims, 13 Drawing Sheets

(56) References Cited

U.S. PATENT DOCUMENTS

| | | | |
|---|---|---|---|
| D35,574 | S | 1/1902 | Thielke |
| D36,574 | S | 10/1903 | Zipp |
| D36,575 | S | 10/1903 | Zipp |
| D36,595 | S | 10/1903 | Peet |
| 937,509 | A | 10/1909 | Carpenter |
| 1,069,972 | A | 8/1913 | Metzaer |
| 1,323,398 | A | 12/1919 | Leland |
| 1,419,712 | A | 6/1922 | Bassette |
| 1,423,800 | A | 7/1922 | Hibbard et al. |
| 1,494,883 | A | 5/1924 | Bassette et al. |
| 1,578,047 | A | 3/1926 | Lum |
| 1,579,705 | A | 4/1926 | Hewitt |
| 1,616,313 | A | 2/1927 | Farmer |
| 1,659,851 | A | 2/1928 | Brewington |
| 1,750,094 | A | 3/1930 | Emmrich |
| 1,765,915 | A | 6/1930 | Haase |
| D81,754 | S | 8/1930 | Mabee |
| 1,816,055 | A | 7/1931 | Pfeifer |
| 2,008,183 | A | 2/1934 | McCord |
| 1,961,179 | A | 6/1934 | Tinkham |
| 1,997,387 | A | 4/1935 | McCord |
| 2,027,605 | A | 1/1936 | McCord et al. |
| 2,041,352 | A | 5/1936 | Jordan |
| D100,310 | S | 7/1936 | Blu |
| 2,130,196 | A | 9/1938 | Sakier |
| 2,192,383 | A | 3/1940 | Krolop |
| 2,202,107 | A | 5/1940 | Korn |
| 2,281,370 | A | 4/1942 | Morrison et al. |
| 2,328,129 | A | 8/1943 | Earle |
| 2,438,762 | A | 3/1948 | McLeckie |
| 2,470,187 | A | 5/1949 | Price |
| 2,479,571 | A | 8/1949 | Hewitt |
| 2,498,699 | A | 2/1950 | Mullett et al. |
| 2,504,740 | A | 4/1950 | Siegel |
| 2,521,769 | A | 9/1950 | Arcularius |
| 2,537,821 | A | 1/1951 | Fodor |
| 2,591,669 | A | 4/1952 | Bucknell et al. |
| 2,606,274 | A | 8/1952 | Spierer |
| RE23,674 | E | 6/1953 | Spierer et al. |
| 2,941,679 | A | 6/1953 | Brodbeck |
| 2,646,629 | A | 7/1953 | Clemens |
| D170,204 | S | 8/1953 | Long |
| 2,651,705 | A | 9/1953 | Clemens |
| 2,666,837 | A | 1/1954 | Brodbeck |
| 2,677,041 | A | 4/1954 | Oliver et al. |
| 2,698,894 | A | 1/1955 | Stein |
| 2,714,151 | A | 7/1955 | Becker |
| 2,761,222 | A | 9/1956 | Bennett |
| 2,767,407 | A | 10/1956 | Weiss |
| 2,777,934 | A | 1/1957 | Falkenthal |
| 2,826,763 | A | 3/1958 | Bass |
| 2,837,835 | A | 6/1958 | Hewitt et al. |
| 2,853,591 | A | 9/1958 | Fine |
| 2,853,592 | A | 9/1958 | Gravet |
| 2,859,535 | A | 11/1958 | Carlson |
| 2,906,627 | A | 9/1959 | Payton et al. |
| 2,908,019 | A | 10/1959 | Lyon, Jr. |
| 2,965,906 | A | 12/1960 | Mullett et al. |
| 2,977,455 | A | 3/1961 | Murphy |
| 3,059,815 | A | 10/1962 | Parson, Jr. |
| 3,065,473 | A | 11/1962 | Sporek et al. |
| 3,076,887 | A | 2/1963 | Bulow |
| 3,128,161 | A | 4/1964 | Hudon |
| D201,493 | S | 6/1965 | Sundberg et al. |
| 3,220,424 | A | 11/1965 | Nelson |
| 3,305,938 | A | 2/1967 | Arthur |
| D210,131 | S | 2/1968 | Rourke |
| 3,384,977 | A | 5/1968 | Rosenberg |
| 3,409,995 | A | 11/1968 | Greenwood et al. |
| 3,415,278 | A | 12/1968 | Yamamoto et al. |
| 3,449,838 | A | 6/1969 | Chancellor |
| 3,480,787 | A | 11/1969 | Johansen |
| 3,487,477 | A | 1/1970 | Classen |
| 3,491,381 | A | 1/1970 | Catheart |
| 3,502,384 | A | 3/1970 | Gipson |
| 3,505,692 | A | 4/1970 | Forbes |
| 3,523,305 | A | 8/1970 | Zorn |
| 3,536,294 | A | 10/1970 | Rodriguez |
| 3,551,919 | A | 1/1971 | Forbes |
| 3,556,158 | A | 1/1971 | Schneider |
| 3,575,583 | A | 4/1971 | Brown |
| 3,575,640 | A | 4/1971 | Ishikawa |
| 3,576,277 | A | 4/1971 | Blackmon |
| 3,585,652 | A | 6/1971 | Forbes et al. |
| 3,585,653 | A | 6/1971 | Forbes et al. |
| 3,587,177 | A | 6/1971 | Overly et al. |
| 3,588,038 | A | 6/1971 | Tanaka |
| 3,603,002 | A | 9/1971 | Spierer |
| 3,613,124 | A | 10/1971 | Ichimori et al. |
| 3,621,199 | A | 11/1971 | Goldstein |
| 3,639,920 | A | 2/1972 | Griffin et al. |
| 3,643,346 | A | 2/1972 | Lester |
| 3,699,984 | A | 10/1972 | Davis |
| 3,711,958 | A | 1/1973 | Lepage |
| 3,724,001 | A | 4/1973 | Ichimori et al. |
| 3,744,149 | A | 7/1973 | Helbling |
| 3,746,035 | A | 7/1973 | Singer |
| 3,757,806 | A | 9/1973 | Bhaskar et al. |
| 3,817,651 | A | 6/1974 | Law et al. |
| 3,878,621 | A | 4/1975 | Duerre |
| 3,904,167 | A | 9/1975 | Touch et al. |
| 3,906,795 | A | 9/1975 | Kask |
| 3,918,987 | A | 11/1975 | Kopfer |
| D238,075 | S | 12/1975 | Harris |
| 3,975,781 | A | 8/1976 | Klimboff et al. |
| 3,992,730 | A | 11/1976 | Davis |
| 4,072,157 | A | 2/1978 | Wines, Jr. et al. |
| 4,120,180 | A | 10/1978 | Jedora |
| 4,144,596 | A | 3/1979 | MacFarlane et al. |
| 4,145,602 | A | 3/1979 | Lee |
| 4,145,769 | A | 3/1979 | MacFarlane et al. |
| D251,795 | S | 5/1979 | McCann |
| 4,193,209 | A | 3/1980 | Lovison et al. |
| 4,195,416 | A | 4/1980 | Hall |
| 4,219,367 | A | 8/1980 | Cary, Jr. et al. |
| 4,239,555 | A | 12/1980 | Scharlack et al. |
| 4,256,133 | A | 3/1981 | Coward et al. |
| D260,678 | S | 9/1981 | Hiller |
| 4,295,233 | A | 10/1981 | Hinkel et al. |
| 4,309,781 | A | 1/1982 | Lissau |
| 4,336,619 | A | 6/1982 | Hinkel et al. |
| 4,375,874 | A | 3/1983 | Leotta et al. |
| 4,383,377 | A | 5/1983 | Crafton |
| 4,398,310 | A | 8/1983 | Lienhard |
| 4,402,095 | A | 9/1983 | Pepper |
| 4,402,331 | A | 9/1983 | Taldo et al. |
| D272,263 | S | 1/1984 | Lienhard |
| 4,429,422 | A | 2/1984 | Wareham |
| 4,453,286 | A | 6/1984 | Weiland |
| 4,461,439 | A | 7/1984 | Rose |
| 4,497,999 | A | 2/1985 | Postbeschild |
| 4,509,543 | A | 4/1985 | Livingston et al. |
| D279,404 | S | 6/1985 | Hiller |
| 4,520,516 | A | 6/1985 | Parsons |
| 4,541,563 | A | 9/1985 | Uetsuhara |
| 4,570,823 | A | 2/1986 | Arabian et al. |
| 4,594,797 | A | 6/1986 | Houck |
| 4,598,726 | A | 7/1986 | Pepper |
| 4,604,764 | A | 8/1986 | Enzo |
| 4,606,085 | A | 8/1986 | Davies |
| 4,610,165 | A | 9/1986 | Duffy et al. |
| 4,611,768 | A | 9/1986 | Voss et al. |
| 4,624,017 | A | 11/1986 | Foletta |
| 4,637,254 | A | 1/1987 | Dyben et al. |
| 4,642,821 | A | 2/1987 | Zanuso et al. |
| 4,642,909 | A | 2/1987 | Garcial |
| 4,644,256 | A | 2/1987 | Farias et al. |
| 4,651,777 | A | 3/1987 | Hardman |
| 4,653,201 | A | 3/1987 | Seaman |
| 4,670,010 | A | 6/1987 | Dragone |
| 4,671,121 | A | 6/1987 | Schieler |
| 4,681,141 | A | 7/1987 | Wang |
| 4,682,628 | A | 7/1987 | Hill |
| 4,685,222 | A | 8/1987 | Houck |

(56) References Cited

U.S. PATENT DOCUMENTS

| | | | |
|---|---|---|---|
| 4,688,277 | A | 8/1987 | Kakinoki et al. |
| 4,688,585 | A | 8/1987 | Vetter |
| 4,700,049 | A | 10/1987 | Rubin |
| 4,702,107 | A | 10/1987 | Guerrini et al. |
| 4,707,867 | A | 11/1987 | Kawabe et al. |
| 4,707,933 | A | 11/1987 | Keck et al. |
| 4,709,728 | A | 12/1987 | Ying-Chung |
| 4,716,605 | A | 1/1988 | Shepherd et al. |
| 4,722,372 | A | 2/1988 | Hoffman et al. |
| 4,735,002 | A | 4/1988 | Rath |
| 4,735,357 | A | 4/1988 | Gregory et al. |
| 4,741,363 | A | 5/1988 | Hu |
| 4,742,583 | A | 5/1988 | Yoshida et al. |
| 4,742,836 | A | 5/1988 | Buehler |
| 4,744,515 | A | 5/1988 | Watanabe |
| 4,746,090 | A | 5/1988 | Hamilton |
| 4,762,273 | A | 8/1988 | Gregory et al. |
| 4,765,003 | A | 8/1988 | Chang |
| 4,767,922 | A | 8/1988 | Stauffer |
| 4,769,863 | A | 9/1988 | Tegg et al. |
| 4,780,595 | A | 10/1988 | Alban |
| 4,785,162 | A | 11/1988 | Kuo |
| 4,823,414 | A | 4/1989 | Piersimoni et al. |
| 4,826,129 | A | 5/1989 | Fong et al. |
| 4,839,039 | A | 6/1989 | Parsons et al. |
| 4,848,599 | A | 7/1989 | Kano et al. |
| 4,852,802 | A | 8/1989 | Iggulden et al. |
| 4,856,122 | A | 8/1989 | Pilolla |
| 4,857,112 | A | 8/1989 | Franninge |
| 4,857,705 | A | 8/1989 | Blevins |
| 4,872,485 | A | 10/1989 | Laverty, Jr. |
| 4,876,435 | A | 10/1989 | Hawkins |
| 4,882,467 | A | 11/1989 | Dimick |
| 4,883,749 | A | 11/1989 | Roberts et al. |
| 4,889,315 | A | 12/1989 | Imanaga |
| 4,894,874 | A | 1/1990 | Wilson |
| 4,909,580 | A | 3/1990 | Mitchell |
| 4,914,758 | A | 4/1990 | Shaw |
| 4,914,833 | A | 4/1990 | Pilolla et al. |
| 4,915,347 | A | 4/1990 | Iqbal et al. |
| 4,916,382 | A | 4/1990 | Kent |
| 4,916,613 | A | 4/1990 | Lange et al. |
| 4,921,129 | A | 5/1990 | Jones et al. |
| 4,921,131 | A | 5/1990 | Binderbauer et al. |
| 4,921,211 | A | 5/1990 | Novak et al. |
| 4,940,298 | A | 7/1990 | Jackson et al. |
| 4,941,219 | A | 7/1990 | Van Marcke |
| 4,942,631 | A | 7/1990 | Rosa |
| 4,948,090 | A | 8/1990 | Chen |
| 4,953,236 | A | 9/1990 | Lee et al. |
| 4,954,179 | A | 9/1990 | Franninge |
| 4,955,535 | A | 9/1990 | Tsutsui et al. |
| 4,959,603 | A | 9/1990 | Yamamoto et al. |
| 4,963,780 | A | 10/1990 | Hochstrasser |
| 4,967,425 | A | 11/1990 | Kawamura et al. |
| 4,971,106 | A | 11/1990 | Tsutsui et al. |
| 4,980,474 | A | 12/1990 | Hayashi et al. |
| 4,980,574 | A | 12/1990 | Cirrito |
| 4,984,314 | A | 1/1991 | Weigert |
| 4,986,221 | A | 1/1991 | Shaw |
| 4,989,755 | A | 2/1991 | Shiau |
| 4,995,585 | A | 2/1991 | Gruber et al. |
| 4,998,673 | A | 3/1991 | Pilolla |
| 5,000,044 | A | 3/1991 | Duffy et al. |
| 5,008,963 | A | 4/1991 | Stein |
| 5,018,550 | A | 5/1991 | Burdorff |
| 5,018,885 | A | 5/1991 | Uggetti |
| 5,025,516 | A | 6/1991 | Wilson |
| 5,031,258 | A | 7/1991 | Shaw |
| 5,031,337 | A | 7/1991 | Pilolla et al. |
| 5,033,508 | A | 7/1991 | Laverty, Jr. |
| 5,033,715 | A | 7/1991 | Chiang et al. |
| 5,060,323 | A | 10/1991 | Shaw |
| 5,062,164 | A | 11/1991 | Lee et al. |
| 5,063,622 | A | 11/1991 | Tsutsui et al. |
| 5,063,955 | A | 11/1991 | Sakakibara |
| 5,072,618 | A | 12/1991 | Taylor et al. |
| 5,074,322 | A | 12/1991 | Jaw |
| 5,074,520 | A | 12/1991 | Lee et al. |
| 5,076,424 | A | 12/1991 | Nakamura |
| 5,080,324 | A | 1/1992 | Chi |
| RE33,810 | E | 2/1992 | Strieter |
| 5,084,984 | A | 2/1992 | Duchoud et al. |
| 5,086,526 | A | 2/1992 | Van Marcke |
| 5,092,560 | A | 3/1992 | Chen |
| 5,095,941 | A | 3/1992 | Betz |
| 5,099,587 | A | 3/1992 | Jarosch |
| 5,111,594 | A | 5/1992 | Allen |
| D326,711 | S | 6/1992 | Lotito et al. |
| 5,117,693 | A | 6/1992 | Duska |
| 5,133,095 | A | 7/1992 | Shiba et al. |
| 5,144,757 | A | 9/1992 | Sasso |
| 5,146,695 | A | 9/1992 | Yang |
| 5,158,114 | A | 10/1992 | Botsolas |
| 5,163,234 | A | 11/1992 | Tsukamoto et al. |
| 5,169,118 | A | 12/1992 | Whiteside |
| 5,170,944 | A | 12/1992 | Shirai |
| D332,194 | S | 1/1993 | Hines |
| D332,195 | S | 1/1993 | Hines |
| D332,196 | S | 1/1993 | Hines |
| D332,365 | S | 1/1993 | Hines |
| D332,366 | S | 1/1993 | Hines |
| D332,369 | S | 1/1993 | Hanna et al. |
| D332,370 | S | 1/1993 | Hanna et al. |
| D332,542 | S | 1/1993 | Hines |
| D332,679 | S | 1/1993 | Hines |
| D332,849 | S | 1/1993 | Hines |
| 5,175,892 | A | 1/1993 | Shaw |
| 5,177,879 | A | 1/1993 | Muta |
| 5,181,328 | A | 1/1993 | Bouverie |
| D332,889 | S | 2/1993 | Hines |
| 5,184,642 | A | 2/1993 | Powell |
| 5,186,360 | A | 2/1993 | Mease et al. |
| D334,266 | S | 3/1993 | Hines |
| 5,193,563 | A | 3/1993 | Melech |
| 5,199,116 | A | 4/1993 | Fischer |
| 5,199,118 | A | 4/1993 | Cole et al. |
| 5,199,188 | A | 4/1993 | Franz |
| 5,202,666 | A | 4/1993 | Knippscheer |
| D336,572 | S | 6/1993 | Gunderson et al. |
| 5,216,251 | A | 6/1993 | Matschke |
| 5,217,035 | A | 6/1993 | Van Marcke |
| 5,224,685 | A | 7/1993 | Chiang et al. |
| 5,226,629 | A | 7/1993 | Millman et al. |
| 5,230,109 | A | 7/1993 | Zaccai et al. |
| D338,361 | S | 8/1993 | Hines |
| 5,239,610 | A | 8/1993 | Shao |
| 5,243,717 | A | 9/1993 | Yasuo |
| D340,374 | S | 10/1993 | Hines |
| D340,375 | S | 10/1993 | Hines |
| 5,251,872 | A | 10/1993 | Kodaira |
| 5,253,376 | A | 10/1993 | Fait |
| 5,255,822 | A | 10/1993 | Mease et al. |
| D341,724 | S | 11/1993 | Hines |
| 5,257,423 | A | 11/1993 | Jacobsen et al. |
| 5,259,410 | A | 11/1993 | Trueb et al. |
| 5,265,288 | A | 11/1993 | Allison |
| 5,265,628 | A | 11/1993 | Sage et al. |
| D342,175 | S | 12/1993 | Hines |
| D342,177 | S | 12/1993 | Hanna et al. |
| 5,267,475 | A | 12/1993 | Gaston |
| 5,269,071 | A | 12/1993 | Hamabe et al. |
| 5,272,918 | A | 12/1993 | Gaston et al. |
| D342,992 | S | 1/1994 | Robertson |
| 5,280,679 | A | 1/1994 | Edelman |
| 5,282,812 | A | 2/1994 | Suarez, Jr. |
| D344,830 | S | 3/1994 | Carter et al. |
| 5,341,839 | A | 8/1994 | Kobayashi et al. |
| 5,347,864 | A | 9/1994 | Senghaas et al. |
| 5,351,347 | A | 10/1994 | Kunkel |
| 5,351,417 | A | 10/1994 | Rubin |
| 5,362,026 | A | 11/1994 | Kobayashi et al. |
| 5,363,517 | A | 11/1994 | Botsolas |
| 5,367,442 | A | 11/1994 | Frost et al. |

(56) References Cited

U.S. PATENT DOCUMENTS 5,369,818 A 12/1994 Barnum et al.
5,377,424 A 1/1995 Albanes
5,377,427 A 1/1995 Mashata
5,397,099 A 3/1995 Pilolla
5,404,419 A 4/1995 Artis, Jr.
5,412,816 A 5/1995 Paterson et al.
5,412,818 A 5/1995 Chen
5,426,271 A 6/1995 Clark et al.
D361,372 S 8/1995 Enthoven
5,438,714 A 8/1995 Shaw
5,438,763 A 8/1995 Yang
5,442,867 A 8/1995 Robinson
D362,901 S 10/1995 Dannenberg et al.
5,459,944 A 10/1995 Tatsutani et al.
D364,675 S 11/1995 Tebbe
5,477,984 A 12/1995 Sayama et al.
5,482,250 A 1/1996 Kodaira
5,497,135 A 3/1996 Wisskirchen et al.
5,504,950 A 4/1996 Natalizia et al.
5,514,346 A 5/1996 Fujita
5,522,411 A 6/1996 Johnson
5,548,119 A 8/1996 Nortier
5,555,912 A 9/1996 Saadi et al.
5,561,871 A 10/1996 Laughton
5,566,404 A 10/1996 Laughton
5,570,869 A 11/1996 Diaz et al.
5,586,746 A 12/1996 Humpert et al.
5,588,636 A 12/1996 Eichholz et al.
5,595,216 A 1/1997 Pilolla
5,610,591 A 3/1997 Gallagher
5,611,093 A 3/1997 Barnum et al.
5,611,517 A 3/1997 Saadi et al.
5,625,908 A 5/1997 Shaw
5,627,375 A 5/1997 Hsieh
5,640,781 A 6/1997 Carson
5,642,462 A 6/1997 Huff
D380,529 S 7/1997 Laughton
5,651,189 A 7/1997 Coykendall et al.
5,651,384 A 7/1997 Rudrich
5,670,945 A 9/1997 Applonie
5,681,630 A 10/1997 Smick et al.
D387,144 S 12/1997 Flaherty
5,694,653 A 12/1997 Harald
5,699,833 A 12/1997 Tsataros
5,701,929 A 12/1997 Helmsderfer
5,727,579 A 3/1998 Chardack
5,730,165 A 3/1998 Philipp
D393,700 S 4/1998 Trueb et al.
5,743,511 A 4/1998 Eichholz et al.
D394,495 S 5/1998 Hauser, II
5,758,688 A 6/1998 Hamanaka et al.
5,765,242 A 6/1998 Marciano
5,769,120 A 6/1998 Laverty, Jr. et al.
5,781,942 A 7/1998 Allen et al.
5,782,382 A 7/1998 Van Marcke
D398,969 S 9/1998 Barnum et al.
5,813,047 A 9/1998 Teichroeb
5,819,335 A 10/1998 Hennessy
5,819,336 A 10/1998 Gilliam et al.
5,829,072 A 11/1998 Hirsch et al.
D402,358 S 12/1998 Bonnell
5,855,356 A 1/1999 Fait
5,868,311 A 2/1999 Cretu-Petra
5,873,178 A 2/1999 Johnson
5,873,179 A 2/1999 Gregory et al.
5,875,562 A 3/1999 Fogarty
5,893,387 A 4/1999 Paterson et al.
5,915,417 A 6/1999 Diaz et al.
5,915,851 A 6/1999 Wattrick et al.
D411,876 S 7/1999 Hafner et al.
5,918,855 A 7/1999 Hamanaka et al.
5,924,148 A 7/1999 Flowers, Sr.
5,943,712 A 8/1999 Van Marcke
5,943,713 A 8/1999 Paterson et al.
5,945,068 A 8/1999 Ferone
5,945,913 A 8/1999 Gallagher
5,950,983 A 9/1999 Jahrling
5,954,069 A 9/1999 Foster
5,961,095 A 10/1999 Schrott
5,966,753 A 10/1999 Gauthier et al.
5,972,126 A 10/1999 Ferni
5,974,685 A 11/1999 Hironaka
5,979,500 A 11/1999 Jahrling et al.
5,984,262 A 11/1999 Parsons et al.
5,988,588 A 11/1999 Allen et al.
5,992,430 A 11/1999 Chardack et al.
6,000,429 A 12/1999 Van Marcke
6,003,170 A 12/1999 Humpert et al.
6,006,388 A 12/1999 Young
6,006,784 A 12/1999 Tsutsui et al.
D420,727 S 2/2000 Hundley
6,018,885 A 2/2000 Hill
6,029,292 A 2/2000 Leiferman et al.
6,029,293 A 2/2000 Paterson et al.
6,038,786 A 3/2000 Aisenberg et al.
D422,346 S 4/2000 Svendsen
6,056,261 A 5/2000 Aparicio et al.
6,059,192 A 5/2000 Zosimadis
6,067,673 A 5/2000 Paese et al.
D428,477 S 7/2000 O'Connell et al.
6,082,407 A 7/2000 Paterson et al.
6,089,086 A 7/2000 Swindler et al.
6,110,292 A 8/2000 Jewett et al.
D431,288 S 9/2000 Helmsderfer
6,119,285 A 9/2000 Kim
D433,109 S 10/2000 Wilke et al.
6,125,482 A 10/2000 Foster
6,127,671 A 10/2000 Parsons et al.
6,128,826 A 10/2000 Robinson
6,131,587 A 10/2000 Chardack et al.
6,142,342 A 11/2000 Lewis
6,161,227 A 12/2000 Bargenquast
6,161,814 A 12/2000 Jahrling
D435,893 S 1/2001 Helmsderfer
6,178,572 B1 1/2001 Van Marcke
6,185,838 B1 2/2001 Moore
6,189,163 B1 2/2001 Van Marcke
6,189,230 B1 2/2001 Huen
6,192,530 B1 2/2001 Dai
6,199,428 B1 3/2001 Estevez-Garcia et al.
6,202,980 B1 3/2001 Vincent et al.
6,206,340 B1 3/2001 Paese et al.
6,209,392 B1 4/2001 Rapala
6,212,707 B1 4/2001 Thompson et al.
6,216,534 B1 4/2001 Ross, Jr. et al.
6,219,857 B1 4/2001 Wu
6,219,859 B1 4/2001 Derakhshan
6,236,317 B1 5/2001 Cohen et al.
6,250,601 B1 6/2001 Kolar et al.
6,253,609 B1 7/2001 Ross, Jr. et al.
6,253,611 B1 7/2001 Varga et al.
6,257,264 B1 7/2001 Sturman et al.
6,267,007 B1 7/2001 Gunther
D446,664 S 8/2001 Petri
D447,224 S 8/2001 Barnum et al.
6,269,695 B1 8/2001 Cesternino et al.
6,273,394 B1 8/2001 Vincent et al.
6,279,179 B1 8/2001 Register
6,279,587 B1 8/2001 Yamamoto
6,282,812 B1 9/2001 Wee et al.
6,286,153 B1 9/2001 Keller
6,289,728 B1 9/2001 Wilkins
6,294,786 B1 9/2001 Maricichow et al.
6,295,410 B1 9/2001 Helms et al.
D448,585 S 10/2001 Petri
6,298,502 B1 10/2001 Brown
6,317,717 B1 11/2001 Lindsey et al.
6,321,785 B1 11/2001 Bergmann
6,322,005 B1 11/2001 Kern et al.
6,340,032 B1 1/2002 Zosimadis
6,341,389 B2 1/2002 Philipps-Libeich et al.
D453,882 S 2/2002 Petri
6,349,484 B1 2/2002 Cohen
6,351,866 B1 3/2002 Bragulla

(56) References Cited

U.S. PATENT DOCUMENTS

| | | | |
|---|---|---|---|
| 6,363,549 | B2 | 4/2002 | Humpert et al. |
| 6,370,951 | B1 | 4/2002 | Kerchaert et al. |
| 6,386,390 | B1 | 5/2002 | Tinker |
| 6,390,125 | B2 | 5/2002 | Pawelzik et al. |
| 6,393,634 | B1 | 5/2002 | Kodaira et al. |
| 6,401,274 | B1 * | 6/2002 | Brown ..... 4/626 |
| 6,408,881 | B2 | 6/2002 | Lorenzelli et al. |
| 6,418,788 | B2 | 7/2002 | Articolo |
| 6,426,701 | B1 | 7/2002 | Levy et al. |
| 6,431,189 | B1 | 8/2002 | Deibert |
| D462,195 | S | 9/2002 | Wang |
| RE37,888 | E | 10/2002 | Cretu-Petra |
| 6,467,514 | B1 | 10/2002 | Korst et al. |
| 6,467,651 | B1 | 10/2002 | Muderlak et al. |
| 6,481,040 | B1 | 11/2002 | McIntyre |
| 6,481,634 | B1 | 11/2002 | Zosimadis |
| 6,484,965 | B1 | 11/2002 | Reaves |
| 6,508,121 | B2 | 1/2003 | Eck |
| 6,523,193 | B2 | 2/2003 | Saraya |
| 6,523,404 | B1 | 2/2003 | Murphy et al. |
| 6,568,655 | B2 | 5/2003 | Paese et al. |
| 6,572,207 | B2 | 6/2003 | Hase et al. |
| D477,060 | S | 7/2003 | Loberger et al. |
| 6,598,245 | B2 | 7/2003 | Nishioka |
| 6,619,320 | B2 | 9/2003 | Parsons |
| 6,624,606 | B2 | 9/2003 | Kushida et al. |
| 6,639,209 | B1 | 10/2003 | Patterson et al. |
| D481,826 | S | 11/2003 | Martinuzzo et al. |
| 6,641,002 | B2 | 11/2003 | Gerenraich et al. |
| 6,643,865 | B2 | 11/2003 | Bork et al. |
| 6,651,851 | B2 | 11/2003 | Muderlak et al. |
| D483,152 | S | 12/2003 | Martinuzzo et al. |
| 6,658,934 | B1 | 12/2003 | Housey et al. |
| D484,958 | S | 1/2004 | Loberger et al. |
| 6,671,890 | B2 | 1/2004 | Nishioka |
| 6,671,898 | B1 | 1/2004 | Eggenberger et al. |
| 6,679,285 | B2 | 1/2004 | Pablo |
| 6,691,340 | B2 | 2/2004 | Honda et al. |
| 6,691,724 | B2 | 2/2004 | Ford |
| 6,711,949 | B1 | 3/2004 | Sorenson |
| 6,711,950 | B1 | 3/2004 | Yamaura et al. |
| 6,715,730 | B2 | 4/2004 | Ehr |
| 6,766,589 | B1 | 7/2004 | Bory et al. |
| D494,258 | S | 8/2004 | Arnold |
| 6,769,197 | B1 | 8/2004 | Tai |
| 6,769,443 | B2 | 8/2004 | Bush |
| 6,770,869 | B2 | 8/2004 | Patterson et al. |
| D496,450 | S | 9/2004 | Loberger et al. |
| 6,789,197 | B1 | 9/2004 | Saito |
| 6,812,657 | B2 | 11/2004 | Raimondi |
| 6,827,294 | B1 | 12/2004 | Fan et al. |
| 6,843,079 | B2 | 1/2005 | Hird |
| 6,857,314 | B2 | 2/2005 | Ohhashi et al. |
| 6,871,541 | B2 | 3/2005 | Weisse |
| 6,882,278 | B2 | 4/2005 | Winings et al. |
| 6,883,563 | B2 | 4/2005 | Smith |
| D507,634 | S | 7/2005 | Loberger et al. |
| 6,912,864 | B2 | 7/2005 | Roche et al. |
| 6,915,690 | B2 | 7/2005 | Okada et al. |
| 6,922,144 | B2 | 7/2005 | Bulin et al. |
| D508,117 | S | 8/2005 | Loberger et al. |
| 6,922,912 | B2 | 8/2005 | Phillips |
| 6,928,235 | B2 | 8/2005 | Pollack |
| 6,929,150 | B2 | 8/2005 | Muderlak et al. |
| D509,577 | S | 9/2005 | Loberger et al. |
| 6,950,606 | B2 | 9/2005 | Logan et al. |
| D511,205 | S | 11/2005 | Loberger et al. |
| D511,821 | S | 11/2005 | Loberger et al. |
| 6,962,005 | B1 | 11/2005 | Khosropour et al. |
| 6,962,168 | B2 | 11/2005 | McDaniel et al. |
| 6,964,405 | B2 | 11/2005 | Marcichow et al. |
| 6,966,334 | B2 | 11/2005 | Bolster |
| 6,968,860 | B1 | 11/2005 | Haenlein et al. |
| D512,648 | S | 12/2005 | Smith et al. |
| 6,980,126 | B2 | 12/2005 | Fournier |
| 6,986,171 | B1 | 1/2006 | Perrin |
| 6,993,968 | B2 | 2/2006 | Kogure |
| 6,996,863 | B2 | 2/2006 | Kaneko |
| 7,007,318 | B1 | 3/2006 | Bork et al. |
| 7,014,166 | B1 | 3/2006 | Wang |
| 7,018,473 | B2 | 3/2006 | Shadrach, III |
| 7,025,227 | B2 | 4/2006 | Oliver et al. |
| 7,039,301 | B1 | 5/2006 | Aisenberg et al. |
| 7,039,963 | B2 | 5/2006 | Loberger et al. |
| 7,079,037 | B2 | 7/2006 | Ross, Jr. et al. |
| D526,394 | S | 8/2006 | Loberger et al. |
| D527,085 | S | 8/2006 | Loberger et al. |
| 7,082,828 | B1 | 8/2006 | Wilkins |
| 7,093,485 | B2 | 8/2006 | Newman et al. |
| D527,809 | S | 9/2006 | Loberger et al. |
| 7,104,519 | B2 | 9/2006 | O'Maley et al. |
| 7,107,631 | B2 | 9/2006 | Lang et al. |
| 7,114,510 | B2 | 10/2006 | Peters et al. |
| 7,150,293 | B2 | 12/2006 | Jonte |
| 7,165,450 | B2 | 1/2007 | Jamnia et al. |
| 7,174,577 | B2 | 2/2007 | Jost et al. |
| D537,927 | S | 3/2007 | Loberger et al. |
| D538,898 | S | 3/2007 | Trepanier |
| D539,400 | S | 3/2007 | Loberger et al. |
| 7,191,484 | B2 | 3/2007 | Dawe |
| 7,191,920 | B2 | 3/2007 | Boll et al. |
| 7,198,175 | B2 | 4/2007 | Ophardt |
| 7,201,052 | B2 | 4/2007 | Lee |
| D542,474 | S | 5/2007 | Churchill et al. |
| 7,219,686 | B2 | 5/2007 | Schmitz et al. |
| 7,228,874 | B2 | 6/2007 | Bolderheij et al. |
| 7,228,984 | B2 | 6/2007 | Tack et al. |
| 7,232,111 | B2 | 6/2007 | McDaniel et al. |
| 7,242,307 | B1 | 7/2007 | LeBlond et al. |
| 7,271,728 | B2 | 9/2007 | Taylor et al. |
| 7,278,624 | B2 | 10/2007 | Iott et al. |
| 7,296,765 | B2 | 11/2007 | Rodrain |
| 7,305,722 | B2 | 12/2007 | Sha et al. |
| 7,315,165 | B2 | 1/2008 | Kleinen et al. |
| 7,318,949 | B2 | 1/2008 | Shadrach, III |
| 7,320,146 | B2 | 1/2008 | Nortier et al. |
| D561,315 | S | 2/2008 | Loberger et al. |
| 7,343,799 | B2 | 3/2008 | Nagakura et al. |
| 7,350,245 | B2 | 4/2008 | Giagni |
| 7,350,413 | B2 | 4/2008 | Nagakura et al. |
| 7,364,053 | B2 | 4/2008 | Ophardt |
| 7,377,163 | B2 | 5/2008 | Miyagawa |
| 7,396,000 | B2 | 7/2008 | Parsons et al. |
| 7,406,722 | B2 | 8/2008 | Fukuizumi et al. |
| 7,409,860 | B2 | 8/2008 | Ferreira et al. |
| 7,437,833 | B2 | 10/2008 | Sato et al. |
| 7,443,305 | B2 | 10/2008 | Verdiramo |
| 7,451,894 | B2 | 11/2008 | Ophardt |
| 7,455,197 | B2 | 11/2008 | Ophardt |
| 7,458,261 | B2 | 12/2008 | Miyagawa |
| 7,464,418 | B2 | 12/2008 | Seggio et al. |
| 7,467,550 | B2 | 12/2008 | Betz, II et al. |
| 7,471,883 | B2 | 12/2008 | Seutter et al. |
| 7,472,433 | B2 | 1/2009 | Rodenbeck et al. |
| 7,477,148 | B2 | 1/2009 | Lynn et al. |
| 7,484,409 | B2 | 2/2009 | Dykstra et al. |
| D588,676 | S | 3/2009 | Loberger et al. |
| 7,516,939 | B2 | 4/2009 | Bailey |
| D591,839 | S | 5/2009 | Loberger et al. |
| 7,527,174 | B2 | 5/2009 | Meehan et al. |
| 7,530,269 | B2 | 5/2009 | Newman et al. |
| 7,533,787 | B2 | 5/2009 | Muderlak et al. |
| 7,537,195 | B2 | 5/2009 | McDaniel et al. |
| 7,555,209 | B2 | 6/2009 | Pradas Diez et al. |
| D599,059 | S | 8/2009 | Clerch |
| 7,588,168 | B2 | 9/2009 | Bagwell et al. |
| 7,596,883 | B2 | 10/2009 | Kameishi |
| 7,597,122 | B1 | 10/2009 | Smith |
| 7,607,442 | B2 | 10/2009 | Barnhill et al. |
| 7,607,443 | B2 | 10/2009 | Barnhill et al. |
| 7,614,096 | B2 | 11/2009 | Vincent |
| 7,614,160 | B2 | 11/2009 | Kameishi et al. |
| 7,617,830 | B2 | 11/2009 | Barnhill et al. |
| 7,627,909 | B2 | 12/2009 | Esche |

(56) References Cited

U.S. PATENT DOCUMENTS

| | | | |
|---|---|---|---|
| 7,631,372 | B2 | 12/2009 | Marty et al. |
| 7,641,173 | B2 | 1/2010 | Goodman |
| 7,641,740 | B2 | 1/2010 | Barnhill et al. |
| 7,650,653 | B2 | 1/2010 | Johnson et al. |
| 7,651,068 | B2 | 1/2010 | Bailey |
| D610,242 | S | 2/2010 | Loberger et al. |
| 7,657,162 | B2 | 2/2010 | Itoigawa et al. |
| 7,659,824 | B2 | 2/2010 | Prodanovich et al. |
| 7,681,447 | B2 | 3/2010 | Nagakura et al. |
| 7,682,464 | B2 | 3/2010 | Glenn et al. |
| D614,273 | S | 4/2010 | Loberger et al. |
| 7,690,395 | B2 | 4/2010 | Jonte et al. |
| 7,690,623 | B2 | 4/2010 | Parsons et al. |
| 7,698,770 | B2 | 4/2010 | Barnhill et al. |
| 7,701,164 | B2 | 4/2010 | Clothier et al. |
| 7,721,602 | B2 | 5/2010 | Benner et al. |
| 7,726,334 | B2 | 6/2010 | Ross, Jr. et al. |
| 7,731,154 | B2 | 6/2010 | Parsons et al. |
| 7,743,438 | B2 | 6/2010 | Chen |
| 7,743,782 | B2 | 6/2010 | Jost |
| 7,750,594 | B2 | 7/2010 | Clothier et al. |
| 7,754,021 | B2 | 7/2010 | Barnhill et al. |
| 7,754,022 | B2 | 7/2010 | Barnhill et al. |
| 7,757,700 | B2 | 7/2010 | Barnhill et al. |
| 7,758,701 | B2 | 7/2010 | Barnhill et al. |
| 7,766,026 | B2 | 8/2010 | Boey |
| 7,766,194 | B2 | 8/2010 | Boll et al. |
| 7,774,953 | B1 | 8/2010 | Duran |
| 7,784,481 | B2 | 8/2010 | Kunkel |
| 7,786,628 | B2 | 8/2010 | Childe et al. |
| 7,789,095 | B2 | 9/2010 | Barnhill et al. |
| 7,797,769 | B2 | 9/2010 | Ozenick |
| 7,804,409 | B2 | 9/2010 | Munro et al. |
| D625,792 | S | 10/2010 | Rundberg et al. |
| 7,812,598 | B2 | 10/2010 | Yasuda et al. |
| 7,814,582 | B2 | 10/2010 | Reddy et al. |
| 7,815,134 | B2 | 10/2010 | Hohl |
| 7,818,083 | B2 | 10/2010 | Glenn et al. |
| 7,819,136 | B1 | 10/2010 | Eddy |
| D628,280 | S | 11/2010 | Loberger et al. |
| 7,825,564 | B2 | 11/2010 | Croft et al. |
| RE42,005 | E | 12/2010 | Jost et al. |
| D629,877 | S | 12/2010 | Rundberg et al. |
| 7,856,736 | B2 | 12/2010 | Churchill et al. |
| 7,860,671 | B1 | 12/2010 | LaCaze |
| D633,992 | S | 3/2011 | Rundberg et al. |
| D637,350 | S | 5/2011 | Kato et al. |
| 7,944,116 | B2 | 5/2011 | Causier |
| 7,946,055 | B2 | 5/2011 | Churchill et al. |
| 7,971,368 | B2 | 7/2011 | Fukaya et al. |
| 8,037,619 | B2 | 10/2011 | Liu |
| 8,064,756 | B2 | 11/2011 | Liu |
| 8,128,465 | B2 | 3/2012 | Collins |
| 8,155,508 | B2 | 4/2012 | Caine et al. |
| 8,201,344 | B2 | 6/2012 | Sawabe et al. |
| 2001/0011389 | A1 | 8/2001 | Philipps-Liebich et al. |
| 2001/0011390 | A1 | 8/2001 | Humpert et al. |
| 2001/0020619 | A1 | 9/2001 | Pfeifer et al. |
| 2002/0006275 | A1 | 1/2002 | Pollack |
| 2002/0019709 | A1 | 2/2002 | Segal |
| 2002/0104159 | A1 | 8/2002 | Nishioka |
| 2002/0157176 | A1 | 10/2002 | Wawrla et al. |
| 2002/0171056 | A1 | 11/2002 | Paese et al. |
| 2003/0037612 | A1 | 2/2003 | Nagakura et al. |
| 2003/0172547 | A1 | 9/2003 | Shephard, II |
| 2003/0188380 | A1 | 10/2003 | Loberger et al. |
| 2003/0210140 | A1 | 11/2003 | Menard et al. |
| 2003/0213062 | A1 | 11/2003 | Honda et al. |
| 2004/0016296 | A1 | 1/2004 | Weisse |
| 2004/0025248 | A1 | 2/2004 | Lang et al. |
| 2004/0083547 | A1 | 5/2004 | Mercier |
| 2004/0128755 | A1 | 7/2004 | Loberger et al. |
| 2004/0129075 | A1 | 7/2004 | Sorenson |
| 2004/0143898 | A1 | 7/2004 | Jost et al. |
| 2004/0149779 | A1 | 8/2004 | Boll et al. |
| 2004/0182151 | A1 | 9/2004 | Meure |
| 2004/0221645 | A1 | 11/2004 | Brzozowski et al. |
| 2004/0221646 | A1 | 11/2004 | Ohhashi et al. |
| 2004/0221647 | A1 | 11/2004 | Sabatino |
| 2004/0238660 | A1 | 12/2004 | Fan et al. |
| 2005/0000015 | A1 | 1/2005 | Kaneko |
| 2005/0087557 | A1 | 4/2005 | Oliver et al. |
| 2005/0098968 | A1 | 5/2005 | Dyson et al. |
| 2005/0199843 | A1 | 9/2005 | Jost et al. |
| 2005/0205818 | A1 | 9/2005 | Bayley et al. |
| 2006/0098961 | A1 | 5/2006 | Seutter et al. |
| 2006/0101575 | A1 | 5/2006 | Louis |
| 2006/0102642 | A1 | 5/2006 | Muntzing et al. |
| 2006/0150316 | A1 | 7/2006 | Fukuizumi et al. |
| 2006/0151513 | A1 | 7/2006 | Shadrach, III |
| 2006/0185074 | A1 | 8/2006 | Loberger et al. |
| 2006/0200903 | A1 | 9/2006 | Rodenbeck et al. |
| 2006/0207019 | A1 | 9/2006 | Vincent |
| 2006/0225200 | A1 | 10/2006 | Wierenga |
| 2007/0023565 | A1 | 2/2007 | Babikian |
| 2007/0079524 | A1 | 4/2007 | Sato et al. |
| 2007/0094787 | A1 | 5/2007 | Hwang |
| 2007/0144034 | A1 | 6/2007 | Kameishi |
| 2007/0151338 | A1 | 7/2007 | Benner et al. |
| 2007/0194637 | A1 | 8/2007 | Childe et al. |
| 2007/0230839 | A1 | 10/2007 | Childe et al. |
| 2007/0252551 | A1 | 11/2007 | Clothier et al. |
| 2007/0261162 | A1 | 11/2007 | Atkinson |
| 2007/0263994 | A1 | 11/2007 | Diez et al. |
| 2007/0278983 | A1 | 12/2007 | Clothier et al. |
| 2008/0005833 | A1 | 1/2008 | Bayley et al. |
| 2008/0018995 | A1 | 1/2008 | Baun |
| 2008/0072668 | A1 | 3/2008 | Miyagawa |
| 2008/0078019 | A1 | 4/2008 | Allen, Jr. et al. |
| 2008/0083786 | A1 | 4/2008 | Marin |
| 2008/0098950 | A1 | 5/2008 | Gudjohnsen et al. |
| 2008/0099088 | A1 | 5/2008 | Boey |
| 2008/0109956 | A1 | 5/2008 | Bayley et al. |
| 2008/0127410 | A1 | 6/2008 | Schmitt et al. |
| 2008/0185396 | A1 | 8/2008 | Yang et al. |
| 2008/0185398 | A1 | 8/2008 | Yang et al. |
| 2008/0185399 | A1 | 8/2008 | Yang et al. |
| 2008/0189850 | A1 | 8/2008 | Seggio et al. |
| 2008/0193111 | A1 | 8/2008 | Seutter et al. |
| 2008/0209760 | A1 | 9/2008 | French et al. |
| 2008/0213644 | A1 | 9/2008 | Shindoh et al. |
| 2008/0216343 | A1 | 9/2008 | Churchill et al. |
| 2008/0216344 | A1 | 9/2008 | Churchill et al. |
| 2008/0222910 | A1 | 9/2008 | Churchill et al. |
| 2008/0253754 | A1 | 10/2008 | Rubin |
| 2008/0256825 | A1 | 10/2008 | Hsu |
| 2008/0271527 | A1 | 11/2008 | Hewitt |
| 2008/0285134 | A1 | 11/2008 | Closset et al. |
| 2008/0289098 | A1 | 11/2008 | Kunkel |
| 2008/0301970 | A1 | 12/2008 | Hackwell et al. |
| 2008/0313918 | A1 | 12/2008 | Dyson et al. |
| 2008/0313919 | A1 | 12/2008 | Churchill et al. |
| 2008/0317448 | A1 | 12/2008 | Brown et al. |
| 2009/0000023 | A1 | 1/2009 | Wegelinn et al. |
| 2009/0000024 | A1 | 1/2009 | Louis et al. |
| 2009/0000142 | A1 | 1/2009 | Churchill et al. |
| 2009/0000147 | A1 | 1/2009 | Collins |
| 2009/0031493 | A1 | 2/2009 | Tsujita et al. |
| 2009/0034946 | A1 | 2/2009 | Caine et al. |
| 2009/0049599 | A1 | 2/2009 | Parsons et al. |
| 2009/0056011 | A1 | 3/2009 | Wolf et al. |
| 2009/0058666 | A1 | 3/2009 | Clabaugh |
| 2009/0069870 | A1 | 3/2009 | Haase et al. |
| 2009/0077736 | A1 | 3/2009 | Loberger et al. |
| 2009/0094740 | A1 | 4/2009 | Ji |
| 2009/0100593 | A1 | 4/2009 | Lincoln et al. |
| 2009/0113746 | A1 | 5/2009 | Churchill et al. |
| 2009/0113748 | A1 | 5/2009 | Dyson et al. |
| 2009/0119832 | A1 | 5/2009 | Conroy |
| 2009/0119942 | A1 | 5/2009 | Aisenberg et al. |
| 2009/0126103 | A1 | 5/2009 | Dietrich et al. |
| 2009/0159612 | A1 | 6/2009 | Beavis et al. |
| 2009/0236358 | A1 | 9/2009 | Rippl et al. |
| 2009/0243243 | A1 | 10/2009 | Watson |

(56) References Cited

U.S. PATENT DOCUMENTS

| | | | |
|---|---|---|---|
| 2009/0266157 | A1 | 10/2009 | Maruo et al. |
| 2009/0293190 | A1 | 12/2009 | Ringelstetter et al. |
| 2009/0293192 | A1 | 12/2009 | Pons |
| 2010/0014844 | A1 | 1/2010 | Dannenberg et al. |
| 2010/0132112 | A1 | 6/2010 | Bayley et al. |
| 2010/0139394 | A1 | 6/2010 | Pauer et al. |
| 2010/0154239 | A1 | 6/2010 | Hutchinson |
| 2010/0168926 | A1 | 7/2010 | Bayley et al. |
| 2010/0192399 | A1 | 8/2010 | Sawabe et al. |
| 2010/0199759 | A1 | 8/2010 | Prasad |
| 2010/0213208 | A1 | 8/2010 | Bem et al. |
| 2010/0219013 | A1 | 9/2010 | Liddell |
| 2010/0223993 | A1 | 9/2010 | Shimizu et al. |
| 2010/0231392 | A1 | 9/2010 | Sherron |
| 2010/0236092 | A1 | 9/2010 | Causier |
| 2010/0269364 | A1 | 10/2010 | Liu |
| 2010/0276529 | A1 | 11/2010 | Nguyen |
| 2010/0296799 | A1 | 11/2010 | Liu |
| 2011/0006083 | A1 | 1/2011 | Walters et al. |
| 2011/0023319 | A1 | 2/2011 | Fukaya et al. |
| 2011/0171083 | A1 | 7/2011 | Swistak |
| 2011/0277342 | A1 | 11/2011 | Ishii et al. |
| 2012/0011739 | A1 | 1/2012 | Nakamura |
| 2012/0017459 | A1 | 1/2012 | Kikuchi et al. |
| 2012/0017460 | A1 | 1/2012 | Kikuchi et al. |

FOREIGN PATENT DOCUMENTS

| | | | |
|---|---|---|---|
| AU | 2006274708 | | 2/2007 |
| AU | 2006274715 | | 2/2007 |
| BE | 347407 | | 12/1927 |
| DE | 504089 | | 7/1930 |
| DE | 2018695 | | 10/1971 |
| DE | 2304815 | | 8/1974 |
| DE | 7707416 | U1 | 7/1977 |
| DE | 2657164 | A1 | 6/1978 |
| DE | 3036623 | | 2/1982 |
| DE | 4218658 | | 12/1992 |
| DE | 9304270 | | 9/1993 |
| DE | 9304160 | | 7/1994 |
| DE | 19608157 | | 7/1997 |
| DE | 10210474 | | 9/2002 |
| DE | 69821140 | | 11/2004 |
| DE | 202004012352 | U1 | 12/2004 |
| DE | 20 2005 018472 | | 2/2006 |
| DE | 20 2007 014808 | | 4/2009 |
| EP | 0 274 785 | A | 7/1988 |
| EP | 1057942 | | 12/2000 |
| EP | 1241301 | | 9/2002 |
| EP | 1250878 | | 10/2002 |
| EP | 1258568 | | 11/2002 |
| EP | 1057441 | | 9/2006 |
| EP | 1912549 | | 3/2010 |
| EP | 2277424 | | 4/2010 |
| EP | 2277424 | | 1/2011 |
| GB | 549766 | | 4/1942 |
| GB | 737054 | | 9/1955 |
| GB | 909069 | | 10/1962 |
| GB | 915674 | | 1/1963 |
| GB | 2249026 | | 4/1992 |
| GB | 2428569 | | 2/2007 |
| GB | 2450563 | A | 12/2008 |
| JP | 61-179993 | | 11/1986 |
| JP | 1256632 | | 10/1989 |
| JP | 04-221523 | | 8/1992 |
| JP | 04-136195 | | 12/1992 |
| JP | 5163748 | A | 6/1993 |
| JP | 05-055988 | | 7/1993 |
| JP | 06-062977 | | 3/1994 |
| JP | 8-140891 | | 6/1996 |
| JP | 08164088 | | 6/1996 |
| JP | 08-196470 | | 8/1996 |
| JP | 9-056640 | | 3/1997 |
| JP | 09-098907 | | 4/1997 |
| JP | 9-135788 | | 5/1997 |
| JP | 9242155 | | 9/1997 |
| JP | 10-113304 | | 5/1998 |
| JP | 10-113305 | | 5/1998 |
| JP | 10/248748 | | 9/1998 |
| JP | 10-257992 | | 9/1998 |
| JP | 10248748 | A | 9/1998 |
| JP | 11-000283 | | 1/1999 |
| JP | 11-113789 | | 4/1999 |
| JP | 2000/000178 | | 1/2000 |
| JP | 2000-000180 | | 1/2000 |
| JP | 2000-157448 | | 6/2000 |
| JP | 2000-184987 | | 7/2000 |
| JP | 2000-300461 | | 10/2000 |
| JP | 2000271039 | | 10/2000 |
| JP | 2000282528 | | 10/2000 |
| JP | 2001-003407 | | 1/2001 |
| JP | 2001-104213 | | 4/2001 |
| JP | 2001140305 | A | 5/2001 |
| JP | 2001-346715 | | 12/2001 |
| JP | 2002-028100 | | 1/2002 |
| JP | 2002-136448 | | 5/2002 |
| JP | 2002/136448 | | 5/2002 |
| JP | 2002-345682 | | 12/2002 |
| JP | 2003153823 | | 5/2003 |
| JP | 2004-215879 | | 8/2004 |
| JP | 2004-261510 | | 9/2004 |
| JP | 2006-081925 | | 3/2006 |
| JP | 2006101987 | | 4/2006 |
| JP | 2006-192250 | | 7/2006 |
| JP | 2006-204738 | | 8/2006 |
| JP | 2006-304926 | | 11/2006 |
| JP | 2007054670 | | 3/2007 |
| JP | 2007-082904 | | 4/2007 |
| JP | 2007-098106 | | 4/2007 |
| JP | 2007082904 | A | 4/2007 |
| JP | 2008-005883 | | 1/2008 |
| JP | 2008/080100 | | 4/2008 |
| JP | 2008-110240 | | 5/2008 |
| JP | 200899787 | A | 5/2008 |
| JP | 2008-272251 | | 11/2008 |
| JP | 2008272086 | | 11/2008 |
| JP | 2010-046238 | | 3/2010 |
| JP | 2010/075602 | | 4/2010 |
| JP | 2010-110450 | | 5/2010 |
| JP | 2011-055859 | | 3/2011 |
| KR | 10-071154 | | 4/2007 |
| NL | 1017777 | | 10/2002 |
| TW | 567822 | U | 12/2003 |
| WO | 96/26795 | | 9/1996 |
| WO | 9626795 | | 9/1996 |
| WO | WO 01/16436 | | 3/2001 |
| WO | WO 2006/055681 | | 5/2006 |
| WO | WO 2007/011747 | A2 | 1/2007 |
| WO | 2007/015036 | | 2/2007 |
| WO | WO 2007/015046 | | 2/2007 |
| WO | 2009/011198 | | 1/2009 |
| WO | WO 2009/039290 | | 3/2009 |
| WO | WO 2009/062546 | | 5/2009 |
| WO | WO 2010/088975 | | 8/2010 |
| WO | WO 2010/089927 | | 8/2010 |
| WO | WO 2010/095250 | | 8/2010 |
| WO | WO 2010/095251 | | 8/2010 |
| WO | WO 2010/119536 | | 10/2010 |
| WO | WO 2011/009156 | | 1/2011 |
| WO | WO 2011/044247 | | 4/2011 |
| WO | WO 2011/077625 | | 6/2011 |

OTHER PUBLICATIONS

Bradley Corporation, "Plumbing Fixtures," believed to be publicly available by Mar. 2006, 3 pages.

U.S. Appl. No. 61/198,293 of William M. Louis, Dispenser That Cantilevers Flexible Sheet Material for Horizontal Presentation, filing date unavailable, 16 pages.

U.S. Appl. No. 61/206,768 of William M Louis, "Swingarm Loading Mechanism for Paper Towel Dispensing Systems," filing date unavailable, 13 pages.

(56) References Cited

OTHER PUBLICATIONS

Bradley Corporation, "Bradpack Preassembled Wash Centers," dated Jan. 1986, 12 pages.
"Innovative Applications in Solid Surface," The Journal of the Solid Surface Industry, Jan./Feb. 2002, vol. 8, No. 1, 3 pages.
Brueton advertisement for Undulatus bench, Home Design—The New York Times magazine, 2 pages.
Bradley Corporation, The Bradley Express Lavatory System: "A look, a feel, an idea as solid as granite," bearing a designation "© Bradley Corporation," 4 pages.
Bradley Corporation, Terreon: "Shaping your designs," bearing a designation "© 1998 Bradley Fixtures Corporation," 8 pages.
Bradley Corporation, "Plumbing Fixtures," bearing a designation "2001,"11 pages.
International Search Report for International Application No. PCT/US2004/07675 including written opinion of the International Searching Authority, mail date Aug. 6, 2004, 7 pages.
International Search Report and Written Opinion for Application No. PCT/US2005/002194, date of mailing May 12, 2005, date received May 18, 2005, 9 pages.
Bradley Corporation, "School Solutions, A higher Dedication to your Design Needs," © 1999 Bradley Corporation, 6 pages.
Bradley Corporation, "Frequency Lavatory Systems," © Bradley Corp 2005, 4 pages.
Bradley Corporation, "Plumbing Fixtures," publicly available by Feb. 14, 2008, 12 pages.
Bradley Corporation, "The ndite™ story," publicly available by Feb. 14, 2008, 2 pages.
Bobrick Technical Data, "Contura™ Series Surface-Mounted Soap Dispenser B-4112," dated May 2006, 1 page.
Bradley Corporation, Total Terreon Concept, © Bradley Corp 2004,2 pages.
Bradley Corporation, Terreon Lav Decks, © Bradley Corp 2004, 2 pages.
Bradley Corporation, "Express Lavatory Systems," © Bradley Corp 2004, 4 pages.
Bradley Corporation, "Frequency Lavatory Systems," © Bradley Corp 2004, 4 pages.
Bradley Corporation, "Terreon Washfountains," © Bradley Corp 2004, 2 pages.
Bradley Corporation, "Sentry Washfountains," © Bradley Corp 2004, 2 pages.
Bradley Corporation, "Classic Washfountains," © Bradley Corp 2004, 2 pages.
Bradley Corporation, "Multi-Fount Washfountains," © Bradley Corp 2004, 2 pages.
Bradley Corporation, "Application Guide," © Bradley Corp 2004, 2 pages.
Bradley Corporation, Washroom Accessories, believed to be publicly available by Jul. 2007,4 pages.
Bradley Corporation, Commercial Washroom Solutions, believed to be publicly available by Jan. 2006, 4 pages.
Bradley Corporation, Washroom Accessories, believed to be publicly available by Aug. 2003, 8 pages.
Bradley Corporation, Washroom Accessories, believed to be publicly available by Jan. 2006,4 pages.
Bradley Corporation, Plumbing Fixtures, believed to be publicly available by Aug. 2002, 12 pages.
Bradley Corporation, Washroom Accessories, believed to be publicly available by Jan. 2008,4 pages.
Bradley Corporation, "Installation Instructions 2483 Surface-Mounted Towel Dispenser," dated Sep. 4, 2003, 1 page.
Bradley Corporation, "Installation 270 Towel Dispenser/Waste Receptacle," dated Jun. 15, 2008, 2 pages.
Bradley Corporation, "Towel Dispenser/Waste Receptacle Model 227," believed to be publicly available by Jun. 2002, 2 pages.
Bradley Corporation, "Towel Dispenser—Center Pull/ Waste Receptacle Model 236," dated Feb. 11, 2005, 1 page.
Bradley Corporation, "Installation 236 Towel/Waste Unit with Center Pull," dated Mar. 9, 2005, 2 pages.
Bradley Corporation, Towel Dispenser Model 2481, dated Dec. 21, 2004,2 pages.
Bradley Corporation, Towel Dispenser Model 2479-000000, dated Mar. 31, 2006, 1 page.
Bradley Corporation, Towel Dispenser Model 2479-110000, dated Feb. 11, 2005, 1 page.
Bradley Corporation, Installation Instructions 2479 Recess-Mounted Towel Dispenser, dated Mar. 3, 2004, 1 page.
Bradley Corporation, "Installation Instructions 2479-11 Surface-Mounted Towel Dispenser," dated Feb. 27, 2004,2 pages.
Bradley Corporation, Towel Dispenser Model 2490, dated Nov. 21, 2005,3 pages.
Bobrick Technical Data, "Contura™ Series Surface-Mounted Paper Towel Dispenser B-4262," dated Jun. 2006, 1 page.
Bobrick Technical Data, "Contura™ Series Surface-Mounted Multi-Roll Toilet Tissue Dispenser B4288," dated May 2006, 1 page.
Bobrick Technical Data, "Contura™ Series Recessed Multi-Roll Toilet Tissue Dispenser B-4388," dated May 2006, 1 page.
Bobrick Technical Data, "Contura™ Series Recessed Paper Towel Dispenser B-4362," dated Nov. 2006, 1 page.
Bobrick Technical Data, "Contura™ Series Recessed Waste Receptacle B-43644," dated Nov. 2006, 1 page.
Bobrick Technical Data, "Contura™ Series Recessed Paper Towel Dispenser and Waste Receptacle B-43944," dated Nov. 2006, 2 pages.
Bobrick Technical Data, "Contura™ Series Surface-Mounted Sanitary Napkin Disposal B-270," dated May 2006, 1 page.
Bobrick Technical Data, "Contura™ Series Recessed Soap Dispenser B-4063," accessed on Mar. 28, 2007, 1 page.
International Search Report for International Application No. PCT/US2008/076875, dated Apr. 3, 2009, 4 pages.
International Search Report and Written Opinion for International Application No. PCT/US2008/076875, mail date Jul. 6, 2009, 21 pages.
Bradley Corporation, "All-In-One-Of-A-Kind" Advocate™ Sell Sheet Brochure Accessed Apr. 2011at http://bradleycorp.com/advocate/Advocate_Sell_Sheet.pdf. 6 pages.
Bradley Corporation Advocate™ Lavatory System—LA90 Series Manual, document No. 1068. Accessed Apr. 2011at http://www.bradleycorp.com/products/fixtures/laysystems/advocate/viewproduct.isp?pgid=1724, © Bradley Corp 2010, 8 pages
Bradley Corporation Advocate™ Lavatory System—LA60 Series Manual, document No. 1066, Accessed Apr. 2011at http://www.bradleycorp.com/products/fixtures/lavsystems/advocate/viewproduct.isp?pgid=1724, © Bradley Corp 2010, 7 pages.
Bradley Corporation Advocate™ Lavatory System—LA30 Installation Manual, document No. 215-1657 Rev. A; ECM 09-08-0026, Accessed Apr. 2011at http://www.bradleycorp.com/products/fixtures/lavsystems/advocate/viewproduct.isp?pgid=1724, dated Oct. 7, 2009 © Bradley Corp 2009, 20 pages.
PCT/Intemational Search Report and Written Opinion—(Application No. PCT/US2010/051647)—11 pages.

* cited by examiner

LAVATORY SYSTEM WITH HAND DRYER

CROSS-REFERENCE TO RELATED APPLICATIONS

This application is a national stage application under 35 U.S.C. §371 of International Application PCT/US10/51647, filed Oct. 6, 2010, which claims the benefit of U.S. Provisional Application No. 61/278,487, filed Oct. 7, 2009, and of U.S. Provisional Application No. 61/324,263, filed Apr. 14, 2010, all of which are incorporated herein by reference in their entireties.

BACKGROUND

The present disclosure relates to a lavatory system. More particularly, the present disclosure relates to a lavatory system that combines one or more hand washing stations with one or more hand drying stations.

Lavatory systems are often used in a public, commercial or industrial, residential or non-residential environments such as a restroom. Such lavatory systems may include one or more hand washing stations having a countertop, a backsplash, a wash basin (with drains) and a faucet configured to be coupled to a plumbing system for providing water (or other cleansing solution) to a user. After a user finishes washing his or her hands at the hand washing station, the user often uses hand drying station to remove any excess water from his or her hands. Examples of hand drying stations include towel dispensers and hand dryers (e.g., electric hand dryers, etc.). The hand drying stations are typically separate from the hand washing stations and require the user to move away from the hand washing station in order to access the hand drying station. Requiring a user to move away from the hand washing station before drying his or her hands may increase the likelihood that water will drip onto the floor. Even when hand drying stations are provided at the washing stations, water is likely to drip and/or be blown onto the user, an adjacent washing stations and/or the floor due to the transition to and the design of the hand drying system.

SUMMARY

One exemplary embodiment of the present invention relates to a lavatory system including a countertop and a first hand washing station. The first hand washing station includes a basin supported by the countertop and a faucet supported by the countertop. The lavatory system also includes a hand dryer, for example an electric hand dryer, including a housing supported by the countertop. The housing defines a cavity in which a user's hands are inserted during drying, and a motor configured to generate blown air which is supplied to the cavity. The housing is located such that the user's hands may be inserted into the cavity without the user leaving the first hand washing station.

Another exemplary embodiment of the present invention relates to a lavatory system including a basin, a faucet adjacent the basin and a hand dryer. The hand dryer includes a housing coupled to the basin, and the housing defines a cavity in which a user's hands are inserted during drying. The hand dryer also includes a first air outlet positioned within the cavity, a second air outlet positioned within the cavity and a device configured to generate moving air which is supplied to the first air outlet and the second air outlet. The first air outlet is positioned to direct moving air downward and rearward towards the user's hands within the cavity, and the second air outlet is positioned within the cavity to direct moving air upward and rearward towards the user's hands in the cavity.

Another exemplary embodiment of the present invention relates to a hand dryer for use with a lavatory system having a basin and a countertop. The hand dryer includes a housing configured to be supported by the countertop, and the housing that defines a cavity in which a user's hands are inserted during drying. The hand dryer also includes a motor configured to generate blow air which is supplied to the cavity.

Another exemplary embodiment of the present invention relates to a lavatory system comprising a first hand washing station including a first countertop, a first basin, a first faucet and a first electric hand dryer located adjacent the first basin and the first faucet so that the user of the first washing station may use the first faucet and the first electric hand dryer without leaving the first washing station. The first electric hand dryer includes a housing defining a cavity in which a user's hands are inserted. The housing includes a reservoir configured to collect water as it is blown off the hands of a user. The reservoir is in fluid communication with a main drain line that services the basin. According to an exemplary embodiment, the reservoir is in fluid communication with the main drain line by having a drain that is coupled to the main drain line. According to another exemplary embodiment, the reservoir is in fluid communication with the main drain line by having a contour that directs water into the basin.

Another exemplary embodiment of the present invention relates to a lavatory system comprising a hand washing station including a basin having a drain configured to be coupled to a main drain line and an electric hand dryer located adjacent the basin so that the user of the washing station may use the electric hand dryer without leaving the first washing station. The electric hand dryer includes a housing defining a cavity in which a user's hands are inserted. The housing includes a reservoir having a drain configured to collect water as it is blown off the hands of a user. The drain of the reservoir is in fluid communication with the main drain line. The hand dryer includes a device configured to accelerate the passage of water down the drain of the reservoir. According to an exemplary embodiment, a motor of the hand dryer is coupled to a conduit that is in fluid communication with the drain of the reservoir and the main drain line in a manner that creates a pressure differential within the conduit that urges water down the drain of the reservoir. According to another exemplary embodiment, one or more fittings are added to the conduit to form a venturi nozzle that creates a pressure differential within the conduit that urges water down the drain of the reservoir.

Another exemplary embodiment of the present invention relates to a lavatory system comprising a hand washing station including a basin, a countertop and a electric hand dryer located adjacent the basin so that the user of the washing station may use the electric hand dryer without leaving the first washing station. The countertop supports that hand dryer and includes an aperture configured to receive the hand dryer so that the hand dryer can be installed from above the countertop.

Another exemplary embodiment of the present invention relates to a lavatory system comprising a hand washing station including a basin and a electric hand dryer located adjacent the basin so that the user of the washing station may use the electric hand dryer without leaving the first washing station. The electric hand dryer includes a housing defining a cavity in which a user's hands are inserted. The housing includes a front wall, a rear wall and a side wall. The side wall is located opposite the side of the basin and is configured to shield an adjacent washing station from water droplets being blown around in the cavity. According to an exemplary embodiment, the rear wall includes a first portion that extends in a substantially vertical direction and a second portion that extends towards a user in a substantially horizontal direction. According to another exemplary embodiment, the housing defines a first cavity entrance provided along an upper or a forward face of the housing and a second cavity entrance provided along a lateral side face of the housing opposite the side wall.

Another exemplary embodiment of the present invention relates to a lavatory system comprising a hand washing station including a basin and a hand dryer located adjacent the basin. The hand dryer includes a housing defining a cavity in which a user's hands are inserted. The hand dryer includes a first air outlet and a second air outlet. The first and second air outlets are positioned to direct air from two different positions within the cavity to dry a user's hands and are positioned such that first air outlet and the second air outlet are located on opposite sides of the user's hand within the cavity. Both the first air outlet and the second air outlet are positioned to direct blown air toward the user's hand and toward the rear of the cavity. According to an exemplary embodiment, the housing includes at least one top wall defining an upper end of the cavity, the top wall inhibiting water from exiting the cavity in a generally vertical direction during drying of the user's hands. According to an exemplary embodiment, at least the first air outlet is located below the top wall. According to an exemplary embodiment, at least one of the air outlets is positioned along a lower surface of the top wall. According to another exemplary embodiment, at least one of the air outlets is aimed to direct air downward within the cavity. According to another exemplary embodiment, the cavity is shaped and positioned to receive the user's hands in a horizontal position, and, in another exemplary embodiment, the cavity is shaped and positioned to receive the user's hand's in a vertical position. The hand dryers are configured to maximize visibility of the user's hands during drying. According to another exemplary embodiment, the cavity includes an opening generally facing the front edge of the countertop, the opening allowing the user's hands to enter and exit the cavity through the opening. According to another exemplary embodiment, the cavity includes an opening generally facing the basin, the opening allowing the user's hands to enter and exit the cavity through the opening. Air is directed at an oblique angle relative to the user's skin so that any materials discharged from the user's skin is directed into the containment cavities or drainage.

The present inventions further relate to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the inventions described herein.

DETAILED DESCRIPTION

Figure 1:
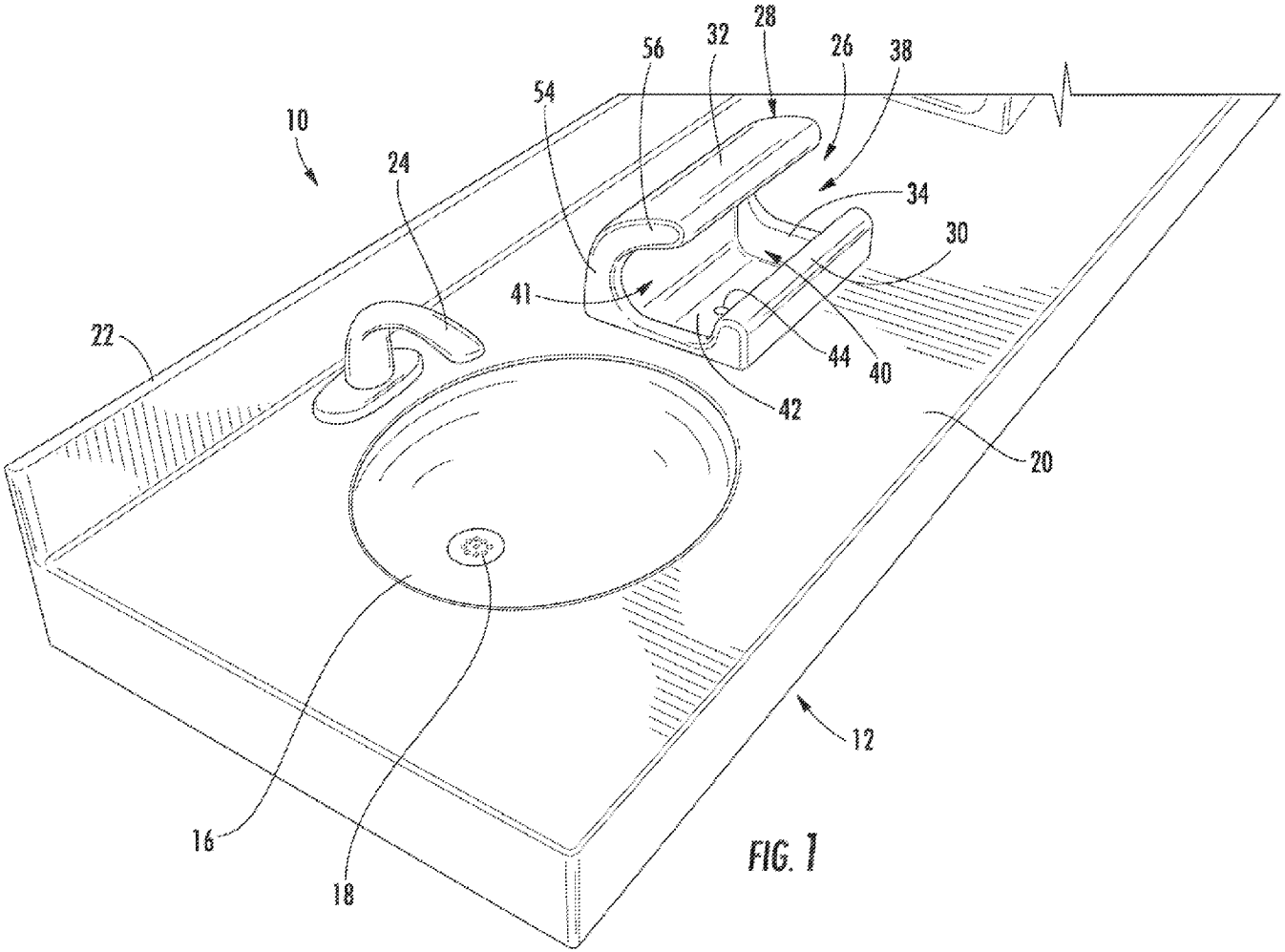
FIG. 1 is a top perspective view of a lavatory system according to an exemplary embodiment.

FIGS. 1 through 14 show a lavatory system 10 and components thereof according to various exemplary embodiments. Lavatory system 10 generally includes one or more washing stations (e.g., hand washing stations). According to the embodiments illustrated, lavatory system 10 includes two hand washing stations, a first station 12 and a second station 14 (shown in FIG. 8A). Alternatively, the lavatory system may include any number of washing stations (e.g., one, three, four, or more) arranged in any of a variety of configurations (e.g., all upper stations, all lower stations, mixed upper/lower stations, etc., set at a variety of upper/lower patterns, heights, or sequences). The washing stations may be configured to be supported by an adjacent wall or may be a freestanding structure configured to be supported by a base (e.g., legs, pedestal, vanity, housing, cabinet, etc.). The hand dryers are configured to maximize visibility of the user's hands during drying. Air is directed at an oblique angle relative to the user's skin so that any materials discharged from the user's skin is directed into the containment cavities or drainage. The hand dryer may be provided as integral with the countertop or deck completely or partially (molded with the rest of the countertop or later attached) as shown in FIGS. 1-7, or as a "drop-in" unit that is received in an opening (from above or below) in the countertop as shown in FIG. 8A.

According to the embodiments illustrated, lavatory system 10 includes at least one hand washing station and at least one hand drying fixture. Each hand washing station generally includes a basin, shown as sink 16 (e.g., bowl, receptacle, etc.), a drain 18, a countertop 20 at least partially surrounding a portion of sink 16, a backsplash 22 extending upwardly at a rear portion of countertop 20, hand washing fixtures 24 (e.g., faucet, soap dispenser, etc.) associated with each sink 16, and, in the embodiments shown, lavatory system 10 includes a hand drying fixture (e.g., electric hand dryer, etc.), shown as hand dryer 26, associated with the hand washing station. In various embodiments, hand dryer 26, sink 16 and/or hand washing fixtures 24 may be supported by (e.g., directly coupled to, integral with, bonded to, formed from the same piece of material as, in contact with, etc.) countertop 20. In some embodiments, sink 16 and/or hand washing fixtures 24 may be supported by countertop 20, and, in contrast to embodiments where hand dryer 26 is also supported by countertop 20, hand dryer 26 may be supported by a wall of the lavatory in proximity to countertop 20.

According to an exemplary embodiment, the one or more of the fixtures (e.g., hand washing fixture 24, hand dryer 26, etc.) may be touchless, meaning that a user can operate the fixtures without physically contacting the fixtures and/or an interface coupled to the fixtures (i.e., hands-free operation). In this manner, the lavatory system is intended to overcome sanitation and/or accessibility limitations often associated with many conventional fixtures. A control system (e.g., control system 180 shown in FIG. 14) monitors a defined sensing region (an area adequately proximate to the fixtures in which a user of the fixture is likely to be positioned) for the presence of an object (e.g., a user, the user's hand, etc.) and controls the operation of the fixtures accordingly. The control system may include a power supply system, a detection system, and a fixture actuation system. In one embodiment, each washing station includes one or more sensors (e.g., hand dryer sensors 184 and 186, fixture sensor 188 shown in FIG. 14). The control system allows the user to activate one or more fixture (e.g., hand washing fixture 24, hand dryer 26, etc.) without touching any part of lavatory system 10 in response to signals received from the one or more sensors. In one embodiment, each hand washing station includes a single sensor and the control system allows the user to operate all of the fixtures located at a single hand washing station in response to signals from the single sensor. In another embodiment, each hand washing station includes one or more dedicated sensors for each fixture associated with the sensor (e.g., a first sensor for hand washing fixture 24, a second sensor for hand dryer 26, etc.). The sensor may be any device that allows for hand free operation of one or more fixtures (e.g., infrared sensors, capacitive sensors, proximity sensors, optical sensors, etc.).

Lavatory system 10 includes a hand dryer 26. Hand dryer 26 is configured to be integrated (e.g., coupled to, mounted adjacent to, part of, etc.) with lavatory system 10. According to an exemplary embodiment, a hand dryer 26 is provided at each first and second washing station 12, 14 so that a user does not have to move away from the washing station before drying his or her hands. In various embodiments, hand dryer 26 is positioned within arms length from the sink. In various embodiments, the lateral side of the hand dryer 26 may be less than about three feet from the nearest portion of the rim of sink 16. In various embodiments, the lateral side of the hand dryer 26 may be less than about two and half feet from the nearest portion of the rim of sink 16, specifically may be less than about two feet from the nearest portion of the rim of the sink 16, and more specifically may be less than about one foot from the nearest portion of the rim of the sink. In one embodiment, the lateral side of the hand dryer 26 may be less than about six inches from the nearest portion of the rim of sink 16.

According to the various alternative embodiments, first and second washing stations 12, 14 having a continuous countertop may share a common hand dryer 26 (e.g., the hand dryer may be mounted on the countertop between the two sinks of the washing stations, etc.). Having access to hand dryer 26 at the washing station, as opposed to a distance away from the washing station, is intended to reduce the likelihood that water from a user's hands will collect on the floor of the facility in which lavatory system 10 is located. According to the embodiments illustrated, hand dryer 26 is supported by countertop 20 of the washing station at a position that is closely adjacent to sink 16 and at approximately the same depth of sink 16 relative to a front edge of countertop 20. As shown in the FIGURES, countertop 20 is configured to be larger on one side to accommodate hand dryer 26.

According to an exemplary embodiment, hand dryer 26 is an electric hand dryer configured to provide forced air in the direction of a user's hands. Hand dryer 26 generally includes an upper housing 28 (e.g., body, casing, etc.) having a first or front portion, shown as front wall 30 (e.g., arm, member, etc.), a second or rear portion, shown as a rear wall 32 (e.g., arm, member, etc.) and a third or side portion, shown as a side wall 34 (e.g., arm, member, etc.). Front wall 30, rear wall 32 and side wall 34 cooperate to define a cavity 38 configured to receive a user's hands. According to an exemplary embodiment, hand dryer 26 may also be configured without side wall 34 (e.g., the exemplary embodiments shown in FIGS. 3 and 7).

According to an exemplary embodiment, hand dryer 26 is supported by countertop 20 at an orientation so that front wall 30 and rear wall 32 are substantially parallel to a front and/or rear edge of countertop 20. Such an orientation may allow a user to insert his or her hands into hand dryer 26 in a rather continuous and direct motion subsequent to using sink 16 (e.g., by moving his or her hands laterally from sink 16, side-to-side, into hand dryer 26). According to the various alternative embodiments, hand dryer 26 may be supported at any of a number of orientations relative to the components of lavatory system 10.

To facilitate the insertion of a user's hands into hand dryer 26, cavity 38 is open at its side end facing sink 16 and opposite side wall 34 as well as at its upper end. The space between a free end (e.g., upper end, etc.) of rear wall 32 and a free end of front wall 30 provides a first cavity entrance, shown as front facing entrance 40. Front facing entrance 40 has a sufficient width and height to allow a user's hands to be at least partially inserted to cavity 38 through front facing entrance 40 by moving the hands from the front, rearwardly into cavity 38. The space between a lateral side of rear wall 32 (shown as the left-facing side in FIG. 1) and a lateral side of front wall 30 (also shown as the left-facing side in FIG. 1) provides a second cavity entrance, shown as lateral facing entrance 41 which faces sink 16. Lateral facing entrance 41 is sufficiently wide to allow a user's hands to be at least partially inserted into cavity 38 through lateral facing entrance 41 by moving the user's hands laterally from sink 16 into cavity 38 to utilize hand dryer 26.

As can be seen from FIGS. 1, 3, 5, 7 and 8C, the shape of front facing entrance 40 is such that upper edges of front wall 30 and rear wall 32 are generally straight and extend laterally across the width of hand dryer 26. Such a shape may encourage a user to enter cavity 38 via lateral facing entrance 41 rather than via front facing entrance 40, which may be preferable because water on a user's hands may be more likely to be contained within lavatory system 10 when lateral facing entrance 41 is used. According to the various alternative embodiments, one or more of the upper edges of front wall 30 and/or rear wall 32 may be contoured (e.g., curved, sloped, angled, etc.) to follow the shape of the hands of a typical user as they are inserted into cavity 38 through front facing entrance 40 to encourage a user to use front facing entrance 40.

Located at a bottom portion of cavity 38 is a collection area (e.g., bottom wall, tray, receptacle, etc.), shown as a reservoir 42, that is configured to at least initially collect water as it is blown or drips off of a user's hands. As shown, cavity 38 is located above reservoir 42. According to an exemplary embodiment, reservoir 42 communicates with drain 18 of sink 16 so that sink 16 and hand dryer 26 share the same main drain line. Such a configuration may advantageously allow water to be removed from hand dryer 26 without having to provide a separate collection device within the hand dryer and/or an independent drain line. By eliminating a separate collection device within the hand dryer, periodic maintenance of the hand dryer, that would otherwise by necessary to empty the water, can be avoided. Providing a shared drain between hand dryer 26 and sink 16 may also simplify the manufacture and/or installation of lavatory system 10.

Figure 2:
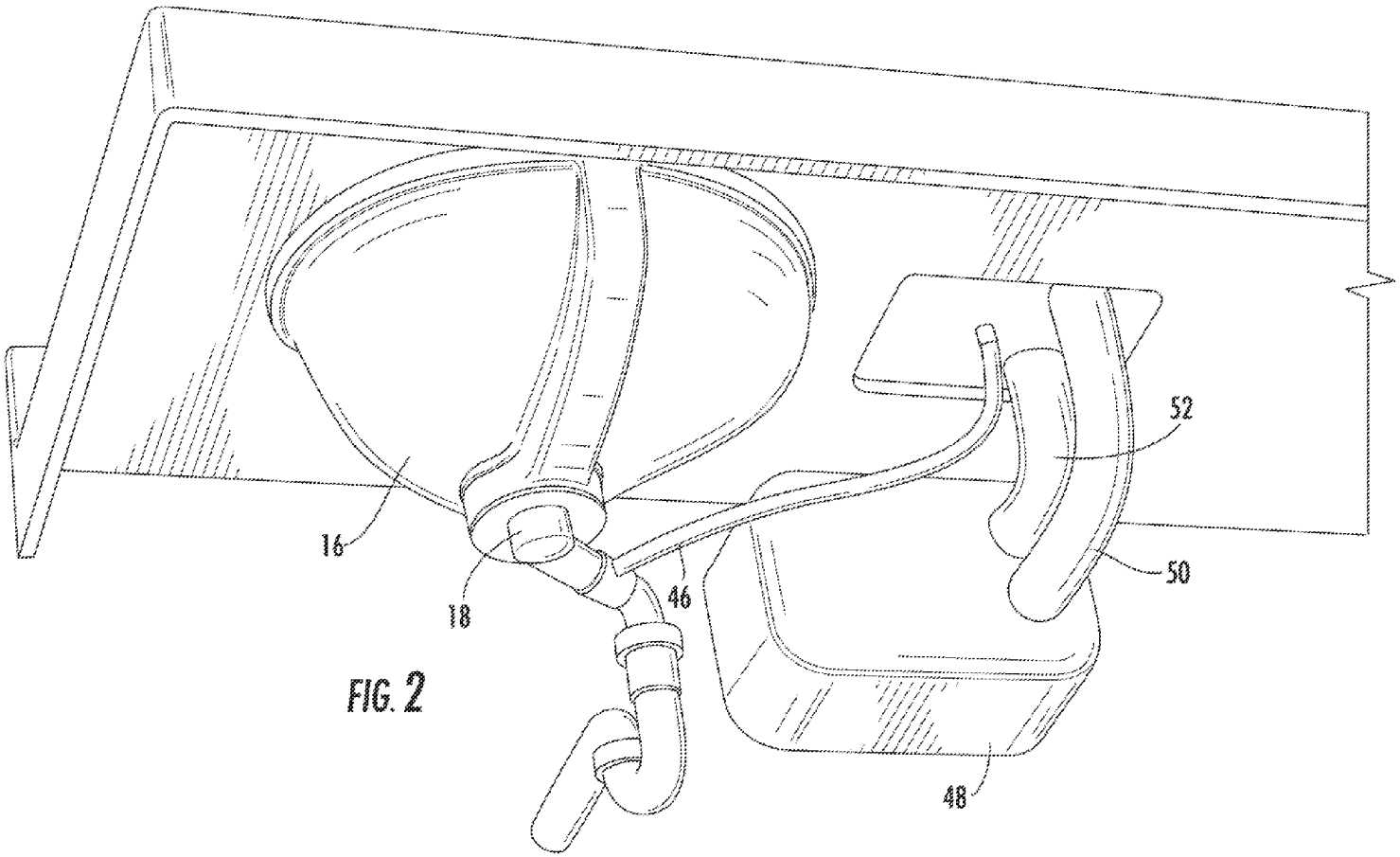
FIG. 2 is a bottom perspective view of the lavatory system of FIG. 1.
Figure 3:
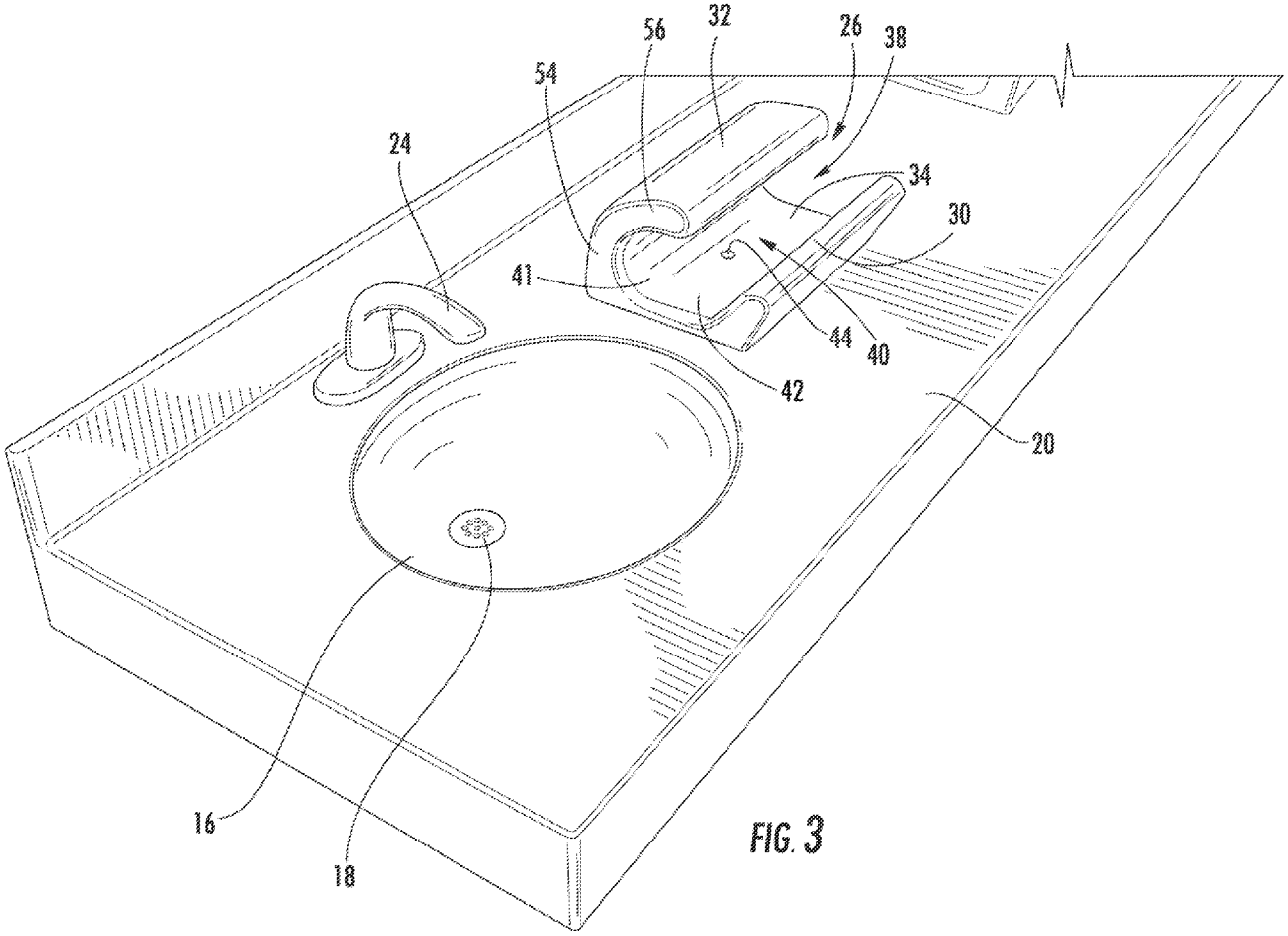
FIG. 3 is a top perspective view of a lavatory system according to another embodiment.
Figure 4:
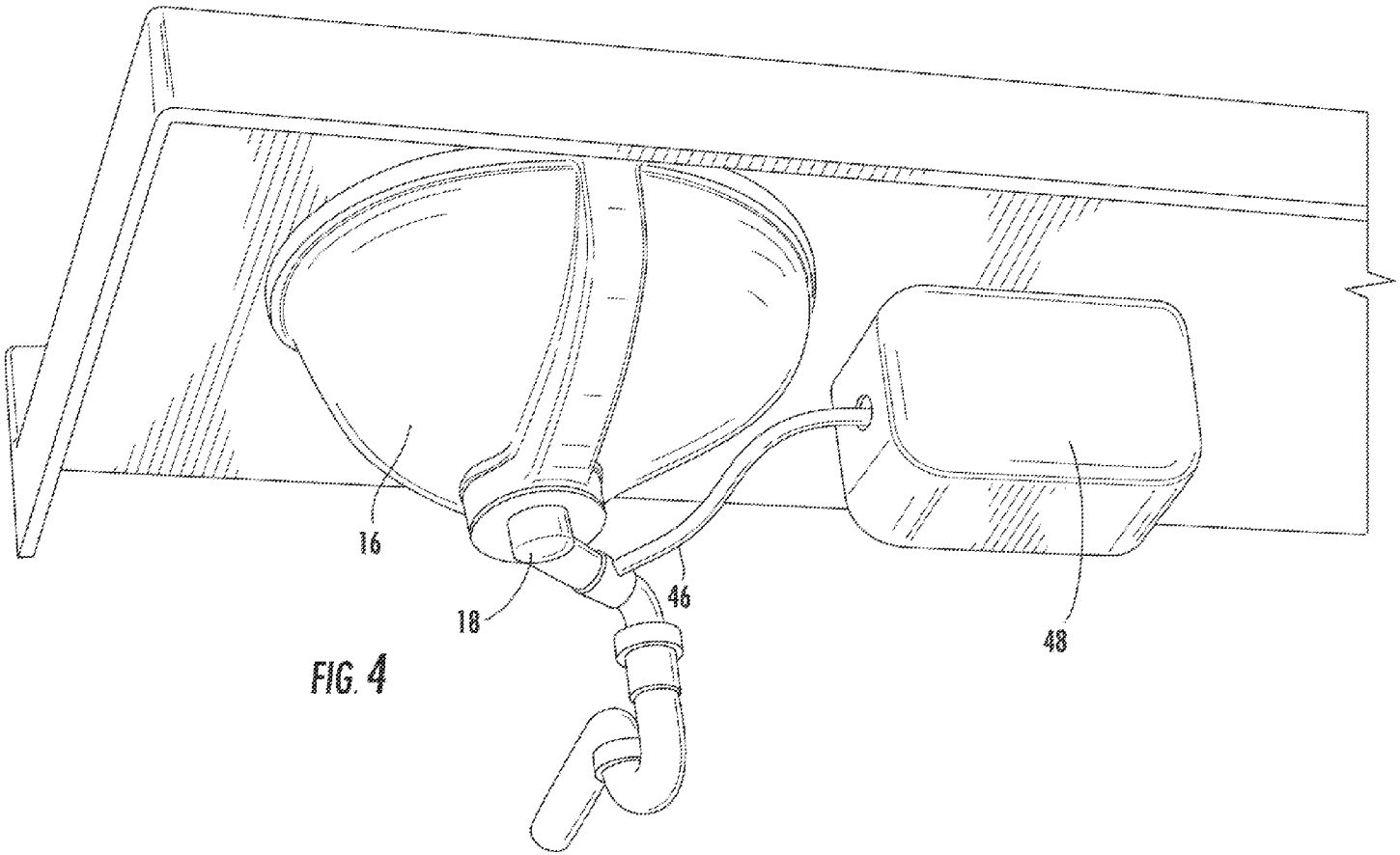
FIG. 4 is a bottom perspective view of the lavatory system of FIG. 3.

Referring to FIGS. 1 through 4, reservoir 42 of hand dryer 26 is shown to be in communication with drain 18 of sink 16 according to a first exemplary embodiment. In such an embodiment, reservoir 42 includes a drain 44 provided at a lowermost portion of reservoir 42. As shown in FIGS. 2 and 4, a conduit 46 is coupled between drain 44 and a portion of drain 18 extending from sink 16. A suitable fitting or connector is provided in the plumbing of drain 18 to receive conduit 46. Water collecting in reservoir 42 flows through drain 44 and conduit 46 into a main drain line of the washing station. Reservoir 42 may be tapered or angled toward drain 44 to help direct water towards drain 44. According to the embodiment illustrated, conduit 46 is provided beneath countertop 20 and out of the way (and sight) of the user. The size and shape of conduit 46 and/or drain 44 may vary depending on the particular requirements of lavatory system 10.

Figure 5:
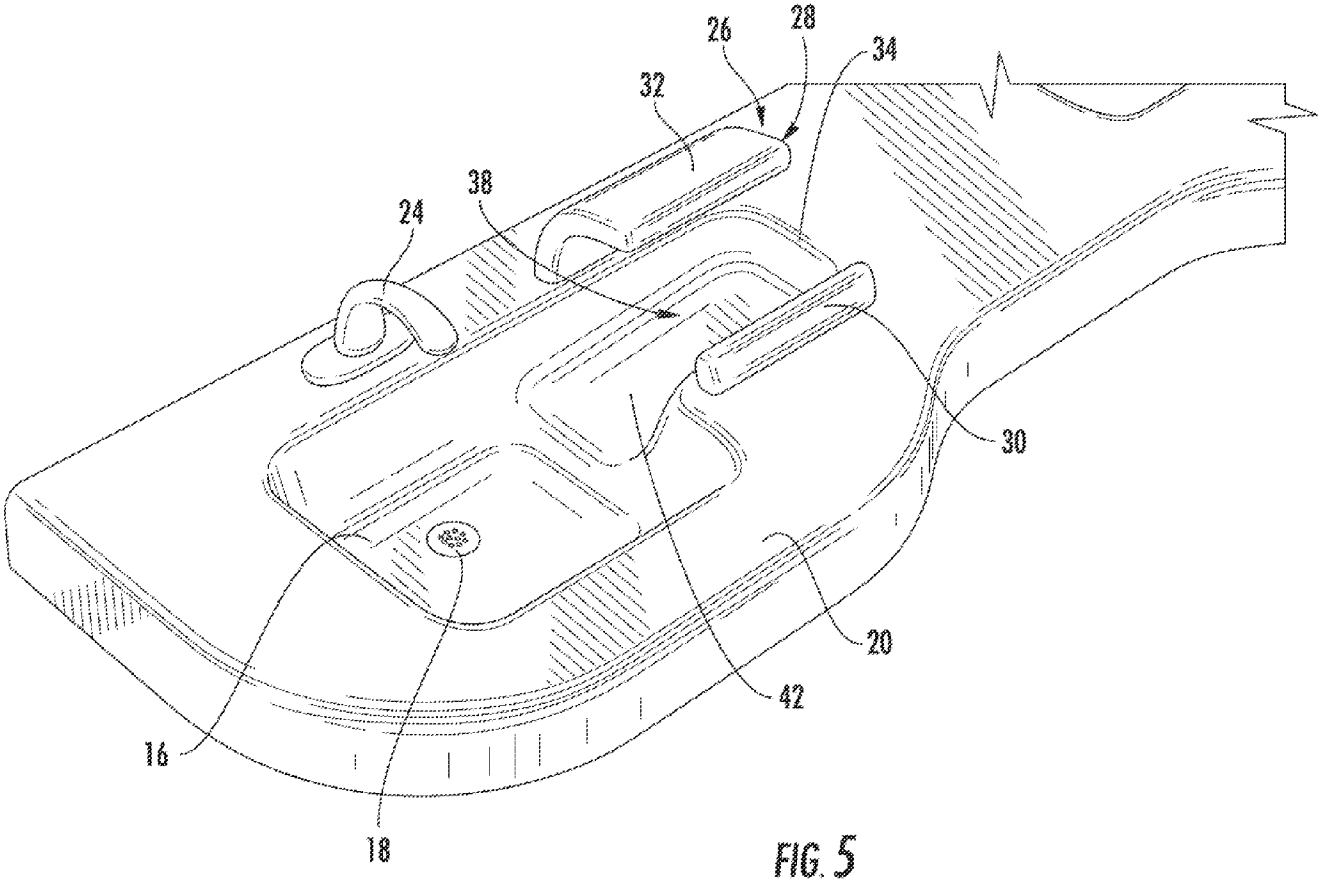
FIG. 5 is a top perspective view of a lavatory system according to another embodiment.
Figure 6:
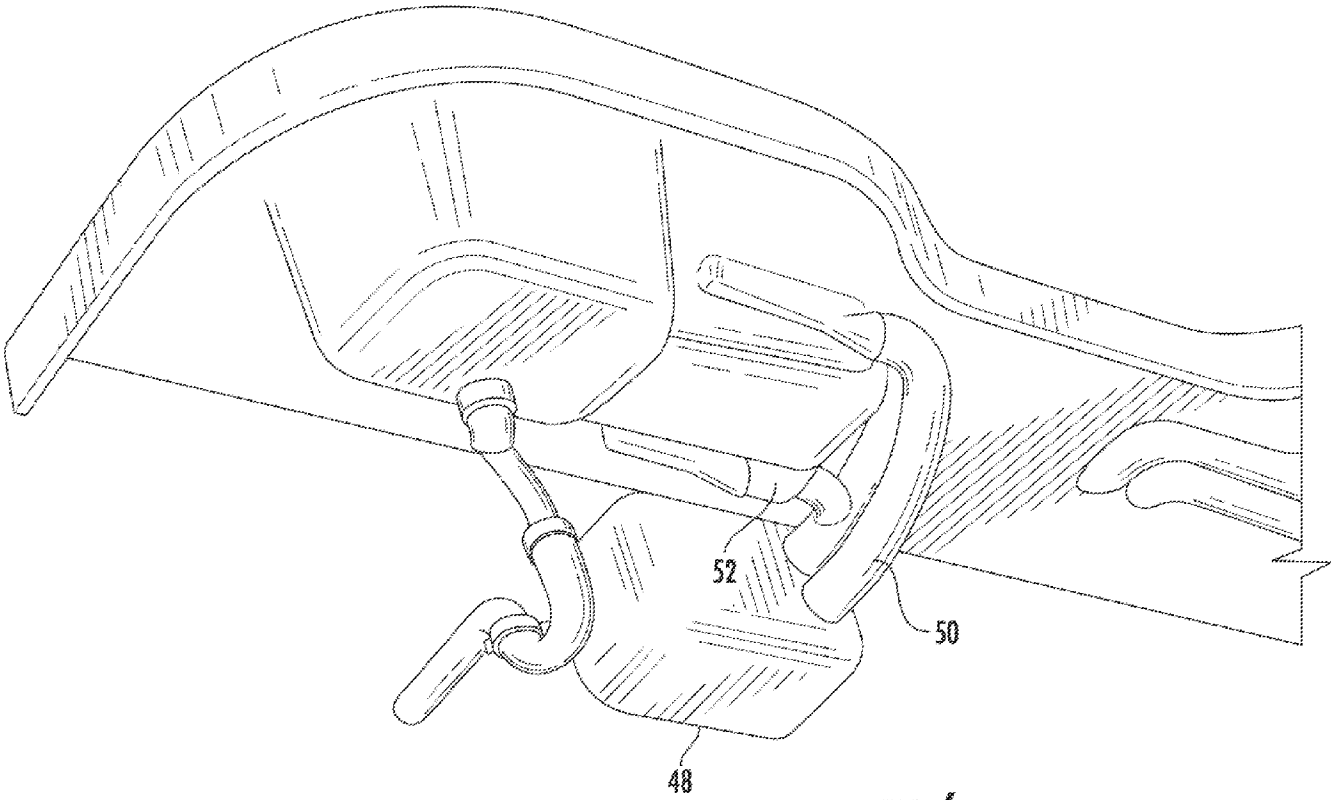
FIG. 6 is a bottom perspective view of the lavatory system of FIG. 5.
Figure 7:
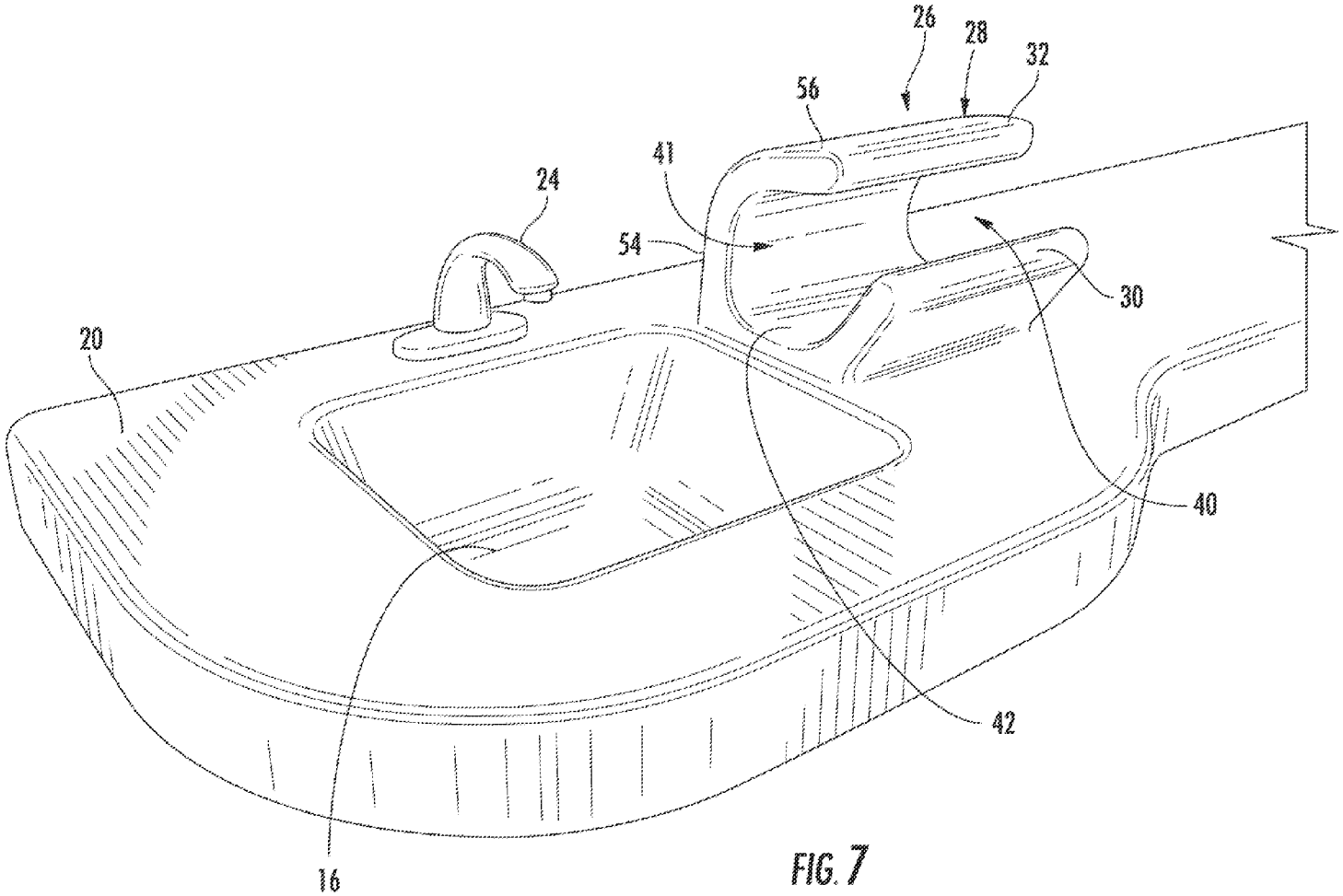
FIG. 7 is a top perspective view of a lavatory system according to another embodiment.
Figure 8A:
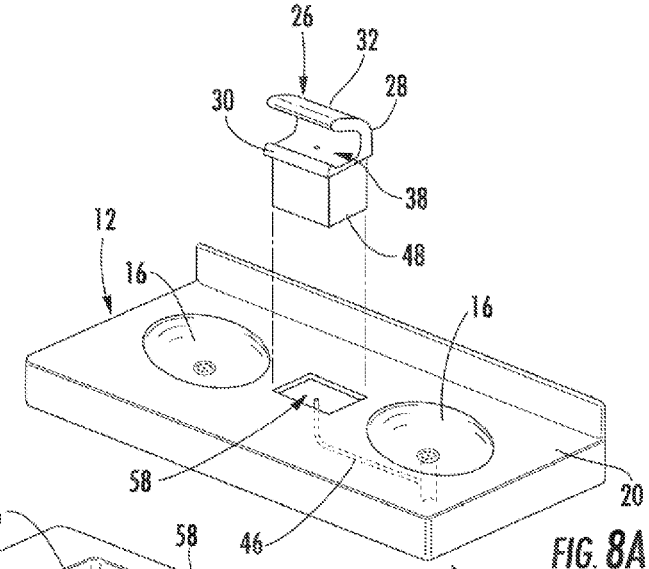
FIG. 8A is an exploded view of a lavatory system having two hand washing stations and a hand dryer according to an exemplary embodiment.

Referring to FIGS. 5 through 7 in particular, reservoir 42 of hand dryer 26 is shown to be in communication with drain 18 of sink 16 according to a second exemplary embodiment. In such an embodiment, reservoir 42 is in communication with sink 16 so that any water collecting in reservoir 42 is transferred to sink 16 where it can flow down drain 18 and into the main drain line. According to the embodiment illustrated, reservoir 42 is provided above the bottom of sink 16 and is contoured (e.g., angled, sloped, curved, etc.) so that water reaching reservoir 42 is directed and flows downward towards sink 16. For example, in the embodiment illustrated, hand dryer 26 is provided along a right side of sink 16. As such, reservoir 42 has a contour that slopes downward from right to left into sink 16. According to such an embodiment, reservoir 42 and/or side wall 34 of hand dryer 26 may be integrally formed with sink 16 and/or countertop 20 as a one-piece unitary member, and front wall 30 and rear wall 32 of housing 28 are provided as separate components configured to be coupled to countertop 20 (as shown in FIGS. 5 and 6). In this embodiment, both reservoir 42 and sink 16 are defined by recessed portions of countertop 20 such that reservoir 42 is integral with sink 16. In another embodiment, the entire hand dryer 26 may be provided as a separate unit that is supported at countertop 20 (as shown in FIG. 8A). In another embodiment, upper housing 28 (e.g., front wall 30 and rear wall 32) and reservoir 42 may be integral with sink 16 and countertop 20 as a one-piece unitary, continuous member (as shown in FIG. 7).

Hand dryer 26 also includes a lower housing 48 (shown in FIGS. 2, 4 and 6) that is configured to support a motor and a fan (or other suitable air moving device) that is driven by the motor. Lower housing 48 may also support one or more heating elements to heat the air moved by the motor and fan. Lower housing 48 includes an air inlet that is in communication with an inlet of the motor. Lower housing 48 is supported substantially beneath countertop 20. According to an exemplary embodiment, a filter may be provided between the air inlet of lower housing 48 and the inlet of the motor to collect contaminants that may otherwise cause damage to the motor and/or the fan, or can contaminate or block the air ducts. The fan includes an air outlet that is coupled to one or more air ducts for transferring the air to one or more air passageways in upper housing 28.

Referring to FIGS. 2 and 6 in particular, and according to an exemplary embodiment, hand dryer 26 includes a first air duct 50 that is configured to transfer air to a first or front air passageway and a second air duct 52 that is configured to transfer air to a second or rear air passageway. The front air passageway is substantially located within the front wall 30 and the rear air passageway is substantially located within the rear wall 32. The front air passageway directs air from the fan (e.g., blower or other air moving device) to one or more air outlets (e.g., apertures, nozzles, etc.) located on an inside surface of front wall 30, while the rear air passageway directs air from the fan to one or more air outlets (e.g., apertures, nozzles, etc.) located on an inside surface of rear wall 32. Alternatively, air distribution may be provided by a single manifold communicating air to the front wall 30 and the rear wall 32. According to an exemplary embodiment, the air outlets are arranged at the ends (e.g., upper ends, lateral side ends, etc.) of front wall 30 and rear wall 32 in the vicinity of front facing entrance 40 and/or lateral facing entrance 41. The air outlets are configured to direct an airflow generally across front facing entrance 40 and/or lateral facing entrance 41 towards the opposite wall of the cavity 38. The air outlets may be positioned (e.g., angled, etc.) so that they blow air rearward, away from front facing entrance 40 and/or away from lateral facing entrance 41 in an effort to contain the water within hand dryer 26 and to direct blow air and water into reservoir 42. Depending on the particular application, the air outlets may be provided as a plurality of holes (e.g., circular, rectangular, etc.), as one or more slot-like openings, or any combination thereof.

For the embodiments in which a drain (e.g., drain 44, etc.) is provided in reservoir 42, a device may be added to assist in moving the water collected in reservoir 42 down the drain in a more rapid or accelerated manner. Water droplets collecting in reservoir 42 may be become airborne (e.g., as a mist, etc.) if the fan continues to blow air through the air outlets while water is in reservoir 42. Once airborne, the water droplets may be sprayed undesirably back onto the user, onto other portions of lavatory system 10, onto the floor and/or onto an adjacent washing station.

According to a first exemplary embodiment, the motor of hand dryer 26 is used to help expedite the drainage of water from reservoir 42 into drain 44. For example, the suction side of the motor may be coupled to conduit 46 to create a pressure differential between the air within reservoir 42 near drain 44 and the air within conduit 46 so that water is urged into conduit 46 towards drain 18. In such an embodiment, a water separator or other suitable device would likely need to be inserted in the line to prevent water and/or other contaminants from entering the motor. According to a second exemplary embodiment, one or more fittings can be added to conduit 46 to form a venturi nozzle which creates a pressure drop in conduit 46 which draws water through drain 44, down conduit 46 and into drain 18. According to the various alternative embodiments, any other device for creating a vacuum and/or pressure drop within conduit 46 may be used to expedite the removal of water from reservoir 42.

One or more sensors are positioned to detect the presence of a user's hands when inserted into cavity 38 via front facing entrance 40 and/or lateral facing entrance 41. Such sensors are arranged to send a signal to the hand dryer motor when a user's hands are introduced to cavity 38. According to an exemplary embodiment, the sensors are configured to inhibit or prevent inadvertent activation of hand dryer 26.

Figure 14:
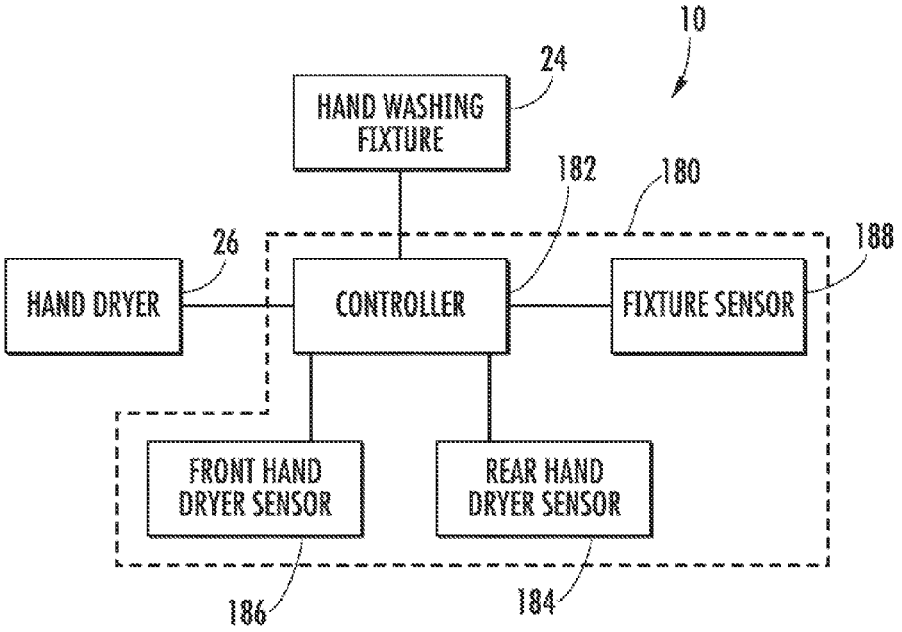
FIG. 14 is a block diagram of a lavatory system including a control system according to an exemplary embodiment.

Referring to FIG. 14, lavatory system 10 may include a control system, shown as control system 180, to control the operation and activation of the various fixtures (e.g., hand washing fixtures 24, an electronically controlled valve associated with the washing fixtures, hand dryers 26, etc.) via user interaction with sensors. As shown in FIG. 14, control system 180 includes one or more sensors 184, 186 and 188 that are in communication with a control circuit (e.g., controller, processor, etc.), shown as controller 182, and controller 182 is in communication with the fixtures (e.g., hand washing fixture 24, hand dryer 26, etc.). Generally, sensors 184, 186 and 188 detect the presence of the user's hands adjacent to the associated fixture, and controller 182 is configured to control the operation of the fixtures based on output signals received from the sensors. Since the fixtures are integrated and located around sink 16 at each wash station, in one embodiment, it is preferred that the fixtures are not inadvertently activated during use of other fixtures.

In the embodiment shown in FIG. 14, control system 180 includes a rear hand dryer sensor 184, front hand dryer sensor 186 and a fixture sensor 188. Controller 182 may be configured (e.g., hardwired, programmed, etc.) to allow activation of only one fixture at a time, allow activation of certain two fixtures at a time (e.g., faucet and soap dispenser), or sequence the fixture activation at predetermined or calculated times and intervals. In addition, controller 182 may be configured to turn off one or more of the fixtures (e.g., the hand washing fixture, etc.) when another of the fixtures is activated (e.g., the hand dryer, etc.). For example, a flow sensor that detects the flow of water through hand washing fixture 24 can be used to disconnect the power from hand dryer 26 or to prevent activation of the hand dryer. Alternatively, a sensor associated with hand dryer 26 (e.g., sensor 184 or sensor 186) communicates with a sensor associated with hand washing fixture 24 (e.g., fixture sensor 188) using signals to activate the hand dryer 26 and deactivate the hand washing fixture 24. This communication may allow controller 182 to prevent the activation of hand washing fixture 24 when hand dryer 26 has been activated. Alternatively, there is no control interaction among the fixtures (i.e., independent operation). The sensors may be directed to provide a sensed area or zone that does not overlap with the sensed zones for other fixtures.

Hand dryer 26 is configured to operate in the following manner in conjunction with the washing station for which hand dryer 26 is associated. When a user of the washing station finishes washing his or her hands, the user remains in front of sink 16 and simply moves his or her hands laterally towards hand dryer 26. At all times during this movement, the user's hands are over sink 16, over countertop 20 and/or within hand dryer 26, thus allowing water to be contained within lavatory system 10. As the user's hands are moved from sink 16 to hand dryer 26 the user's hands are not directly positioned over the floor of the lavatory which limits or prevents water from dripping onto the floor from the user's hands.

In one embodiment, when a user's hands are first inserted into cavity 38 through front facing entrance 40 or lateral facing entrance 41, one or more sensors (e.g., rear hand dryer sensor 184, front hand dryer sensor 186) detect the presence of the user's hands and send a signal directly to the motor to drive the fan. The fan is thus rotated and air is drawn into lower housing 48 through the air inlet. The airflow leaving the fan is divided into two separate airflows, a first airflow directed into first duct 50 and a second airflow directed into the second duct 52. Alternatively, the first duct 50 and the second duct 52 may be a common manifold delivering air to front wall 30 and rear wall 32 passageways. First duct 50 and second duct 52 direct the airflow to air passageways in front wall 30 and rear wall 32 respectively for exiting from the air outlets. In another embodiment, shown in FIG. 14, the sensors associated with the hand dryer communicate with controller 182, which in turn controls the operation of the motor and fan of the hand dryer.

The air flows from the air outlets and is directed towards the surfaces of the user's hands which, during use, are inserted into cavity 38 and are subsequently withdrawn from cavity 38 via front facing entrance 40 and/or lateral facing entrance 41. As the user's hands pass into and out of cavity 38, the air exiting the air outlets blows any existing water or material off the user's hands. To dry a user's hands it will take only a small number of passes of the hands between the air outlets. The water removed by the air is collected inside cavity 38 by reservoir 42. The water droplets will fall to reservoir 42 under the forces of gravity while the air exits cavity 38 either through front facing entrance 40 and/or through lateral facing entrance 41. Water collected in reservoir 42 is directed to the main drain line that is servicing sink 16. Depending on the configuration of reservoir 42, water is directed to the main drain line by being emptied into sink 16 and/or by being passed through conduit 46, which is in communication with the main drain line, as discussed above.

At least partially because of the configuration of rear wall 32 and front wall 30, the air exiting the air outlets is contained within cavity 38. This reduces the risk of air and/or water being blown onto other parts of the user (e.g., face, torso, etc.), onto the other parts of lavatory system 10, onto the floor and/or onto an adjacent washing station. For example, referring to FIGS. 1, 3, 5, and 7, rear wall 32 may include a first portion 54 that extends in a substantially vertical direction and a second portion 56 that extends in a substantially horizontal direction to at least partially enclose cavity 38. According to an exemplary embodiment, first portion 54 and second portion 56 are integrally formed as a one-piece unitary body, but alternatively, may be provided as separate components that are coupled together. Further, second portion 56 is preferably orientated at a slight angle relative to a horizontal plane to facilitate access to cavity 38 via front facing entrance 40 and lateral facing entrance 41. Front wall 30 may also be angled toward the front edge of counter 20 for this purpose, as shown in FIGS. 3 and 7.

To further assist in preventing air and/or water from being blown onto other parts of the user (e.g., face, torso, etc.), onto the other parts of lavatory system 10, onto the floor and/or onto an adjacent washing station, third wall 34 is provided. As shown in FIGS. 1 and 5, third wall 34, is a sidewall, and is provided at a lateral end of hand dryer 26 that is opposite the side of hand dryer 26 that is open to sink 16. Third wall 34 functions as a shield or a deflector (e.g., deflection plate, etc.) and is configured to contain the water as it is being blown off of a user's hands. The positioning of third wall 34 advantageously allows it to reduce the likelihood that water (or mist) will be blown onto the floor and/or onto an adjacent washing station. According to an exemplary embodiment, third wall 34 spans the entire distance between front wall 30 and rear wall 32, but alternatively may be provided at only a portion of such distance. The height of side wall 34 may vary depending on a number of factors (e.g., the pressure at which air is ejected from air outlets, the type of drainage provided for reservoir 42, etc.). However, in the embodiment shown in FIG. 1, the height of side wall 34 is greater than the height of any wall provided on an opposite lateral side of hand dryer 26. Preferably, no wall, or a relatively small wall, is provided on the side opposite side wall 34 so that second cavity opening 41 remains unobstructed.

Referring to FIGS. 8A-8G, in various embodiments, lavatory system 10 is configured to provide for improved manufacturing, inventory control, assembly, installation and maintenance by incorporating common or universal components (at least in the manufacturing stage) that are configurable or reconfigurable for a variety of lavatory system designs and/or configurations (e.g., one-station, two-station, three-station, etc.). For example, lavatory system 10 is shown as being formed with an aperture 58 in countertop 20 that is configured to accept hand dryer 26. In this embodiment, hand dryer 26 may be directly coupled to countertop 20 by a portion of upper housing 28 seating (e.g., contacting, engaging, etc.) the portion of countertop 20 surrounding aperture 58, and with hand dryer 26 in place various fasteners (e.g., bolts, screws, adhesives, etc.) may be applied to hold hand dryer 26 in place. Thus, when hand dryer 26 is coupled to countertop 20 in this embodiment, most of upper housing 28 and of cavity 38 are positioned above countertop 20 while lower housing 48 is positioned below countertop 20. In such an embodiment, hand dryer 26 may be provided as a self-contained unit that can be readily installed adjacent to sink 16. Providing a hand dryer that can simply be dropped into countertop 20 for installation may advantageously simplify installation.

In the embodiment shown in FIG. 8A, lavatory system 10 may be configured such that a single hand dryer 26 services both hand washing station 12 and hand washing station 14. In this embodiment, hand dryer 26 is received by a single aperture 58 that is located between sink 16 of hand washing station 12 and sink 16 of hand washing station 14. In another embodiment, shown in FIG. 8B, lavatory system 10 may be configured such that one hand dryer 26 services hand washing station 12, and another hand dryer 26 services hand washing station 14. In this embodiment, countertop 20 includes an aperture 58 located adjacent to sink 16 of hand washing station 12 and another aperture 58 located adjacent to sink 16 of hand washing station 14. In this embodiment, a separate hand dryer 26 may be received in the aperture 58 associated with each hand washing station.

Figure 8B:
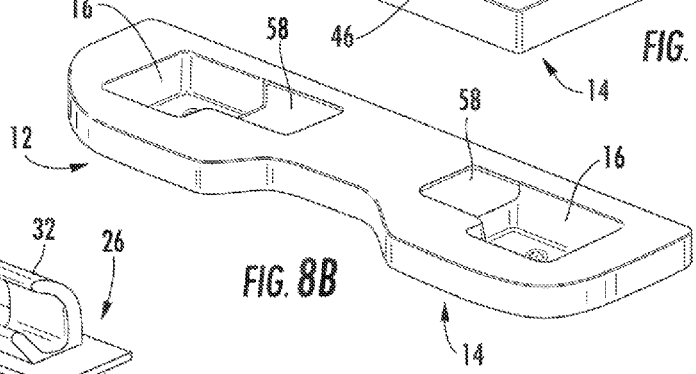
FIG. 8B is a top perspective view of a lavatory system having two hand washing stations according to another exemplary embodiments.

The multi-station lavatory systems shown in FIGS. 8A and 8B are configured to provide hand washing access to multiple users at the same time. While first and second washing stations 12, 14 are shown as being provided at substantially the same height, first and second washing stations 12, 14 may be configured to have different heights to accommodate persons having varying abilities or characteristics for using a lavatory system (e.g., disabled, tall, short, etc.). For example, first washing station 12 may be an upper station, while second washing station 14 may be a lower station. In such an embodiment, upper station 12 has a height (e.g., the distance from the floor to the upper surface of the counter surrounding the basin) that is greater than 34 inches (e.g., about 36 inches) and lower station 14 has a height that is about 34 inches to accommodate an adult user in a wheelchair. In another embodiment, lower station 14 has a height that is about 31 inches to accommodate a juvenile user in a wheelchair. In another embodiment, lower station 14 has a height that is less than 31 inches (e.g., about 28 inches). In another embodiment, upper station 12 has a height that is about 34 inches, and lower station 14 has a height that is about 31 inches. In other embodiments, lavatory system 10 may include any number of hand washing stations (e.g., 3, 4, 5, etc.), each hand washing station located at one of the heights discussed above or any other height.

As can be seen in the FIGURES, the hand dryer embodiments discussed herein are supported adjacent to the sink such that the heights of the entrances or openings of the hand dryer are substantially the same as the height of the adjacent sink. For example, as shown in FIG. 7, the heights of the middle of front facing entrance 40 and of lateral facing entrance 41 are substantially the same as height of the output end of hand washing fixture 24, and the height of the lowest or bottom edge of lateral facing entrance 41 is substantially the same as the height of sink 16. Thus, if a user is able to access the sink of a particular hand washing station, the user is also likely able to access the hand dryer positioned adjacent to the sink. Accordingly, the arrangement of the sinks and hand dryers of lavatory system 10 discussed herein help to ensure that both the sinks and hand dryers are easily accessible to a variety of people of different characteristics and abilities.

Figure 8C:
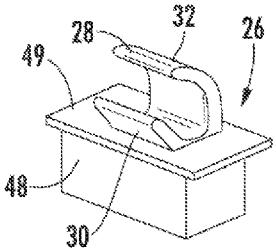
FIG. 8C is a top perspective of hand dryer according to an exemplary embodiment.
Figure 8D:
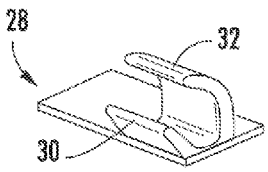
FIG. 8D is a top perspective of hand dryer housing according to another exemplary embodiment.
Figure 8E:
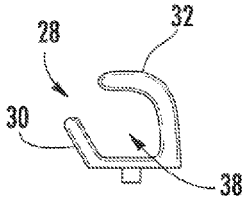
FIG. 8E is a side view of the hand dryer housing of FIG. 8D.
Figure 8F:
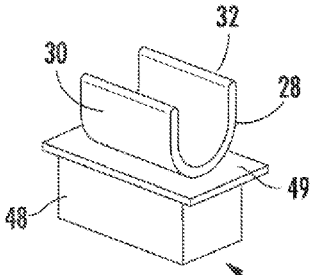
FIG. 8F is a top perspective view of a hand dryer according to another exemplary embodiment.

Referring to FIGS. 8C-8G, various embodiments of hand dryers 26 and upper housings 28 that may be coupled to countertop 20 are shown. FIGS. 8C and 8F shows a hand dryer 26 having an upper housing 28 with a front wall 30 and a rear wall 32 and a lower housing 48. In this embodiment, upper housing 28 of hand dryer 26 has a rim or collar 49 above lower housing 48. Collar 49 is the portion of the housing that seats the area of countertop 20 surrounding aperture 58 to support hand dryer 26 from countertop 20. FIG. 8C shows a hand dryer 26 having an angled front wall 30 and a curved rear wall 32 similar to the hand dyer shown in FIG. 1. FIG. 8F shows a hand dryer 26 having vertically positioned, substantially parallel front and rear walls 30 and 32.

Figure 8G:
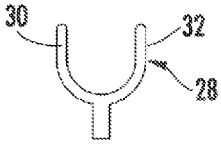
FIG. 8G is a side view of the upper housing of the hand dryer of FIG. 8F according to an exemplary embodiment.

Referring to FIGS. 8D, 8E and 8G, various embodiments of modular upper housings 28 are shown according to various embodiments. In various embodiments, lavatory system 10 is configured to allow for selection and assembly of the system using various shapes, styles, designs, etc., for the particular upper housing 28 that is used in conjunction with a particular hand dryer 26 of the lavatory system. In these embodiments, the lower housing 48 (including, the motor, fan, etc.) of the hand dryer may be coupled below countertop 20, and upper housing 28 may be fitted within aperture 58 and connected to the already installed lower housing 48. This flexibility allows for creation of a customized lavatory system 10 having various combinations of hand dryer housing styles. Further, providing modular upper housings 28 facilitates replacement in the event that a previous upper housing 28 is damaged.

Figure 9:
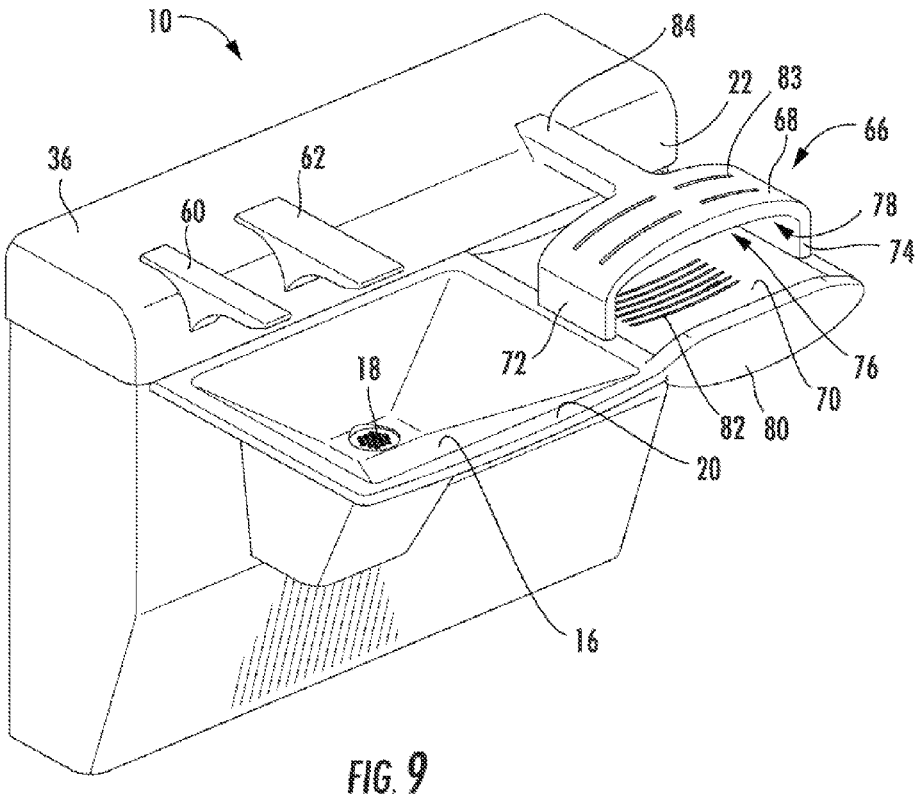
FIG. 9 is a top perspective view of a lavatory system according to another embodiment.
Figure 10:
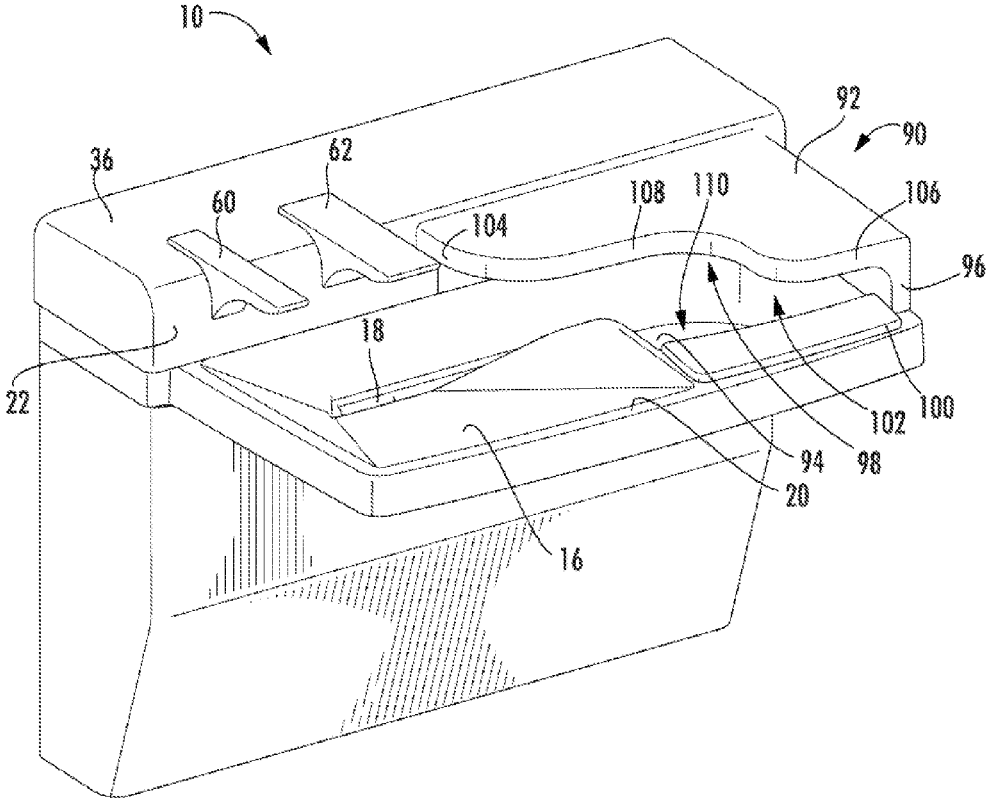
FIG. 10 is a top perspective view of a lavatory system according to another embodiment.
Figure 11:
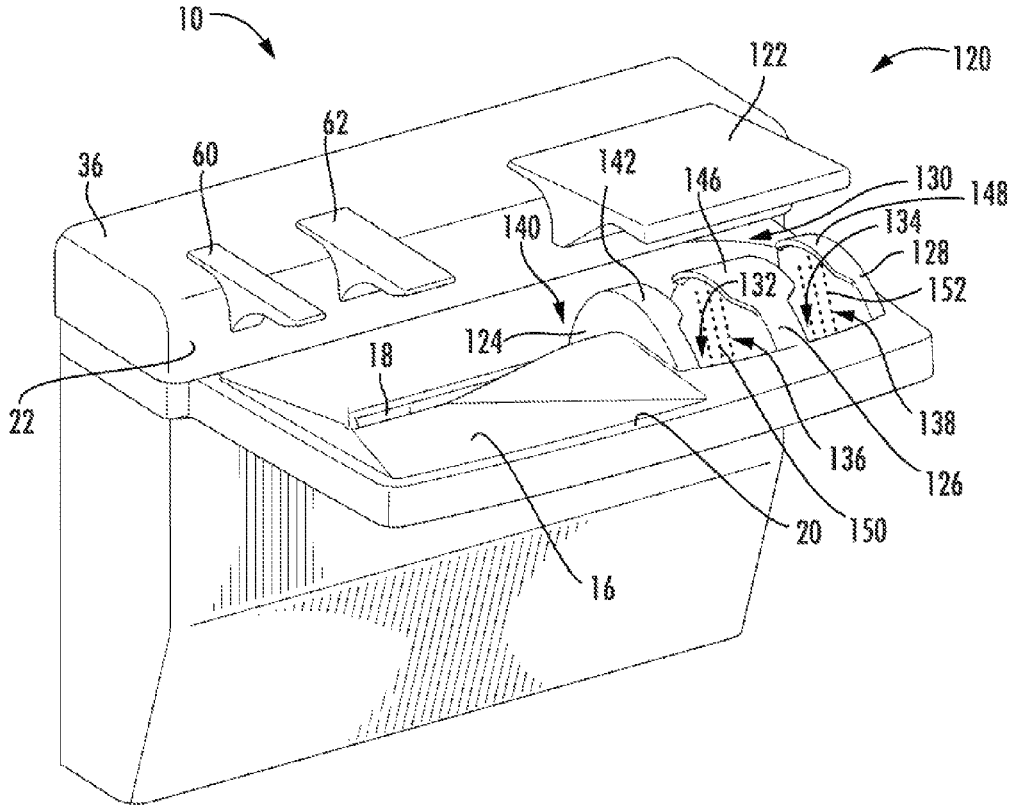
FIG. 11 is a top perspective view of a lavatory system according to another embodiment.

Referring to FIGS. 9 through 11, various additional embodiments of lavatory system 10 are shown. Similar to the embodiments discussed above, each of the lavatory system embodiments shown in FIGS. 9 through 11 include one or more hand washing stations and one or more hand dryers positioned adjacent to the hand washing station. In each of the lavatory system embodiments shown in FIGS. 9 through 11, the hand dryers are supported by the countertop and are configured to provide for containment of air and water during hand drying to limit or prevent inadvertent splashing of water onto the user, floor, adjacent hand washing or drying stations, etc.

Further, in various embodiments, each of the hand dryers include at least two air outlets positioned such that air is directed at the user's hands from at least two different directions on opposite sides of the user's hands. Thus, in various embodiments, the hand dryers discussed herein provide for bi-directional or multi-directional airstreams within the drying cavity. In the various embodiments, the hand dryers include one or more drying cavities that receive a user's hands during a drying operation, and the drying cavities are sized to provide containment of air and water and yet to provide an open feel suitable for public restrooms. In the various embodiments, the drying cavities of the hand dryers are shaped and positioned to allow the user to hold their hands in a natural, comfortable position during the drying operation without the user's hands contacting the inner surface of the hand dryer cavity. Further, in the various embodiments, the drying cavity includes one or more openings conveniently positioned to allow the user's hands to enter and exit the drying cavity. The hand dryer may include at least two spaced apart, opposing air outlets positioned to deliver blown air to the cavity. In one such embodiment, the air outlets are formed along the inner surface of the hand dryer housing that defines the hand drying cavity.

As discussed above, lavatory system 10 includes a sink 16 having a drain 18, a countertop 20 at least partially surrounding a portion of sink 16, a backsplash 22 extending upwardly at a rear portion of countertop 20 and a generally horizontal shelf or platform 36 extending from the upper edge of backsplash 22. Lavatory system 10 also includes a plurality of hand washing fixtures, shown as a soap dispenser 60 and a faucet 62, extending from the front edge of platform 36 toward the front edge of countertop 20 generally above sink 16.

The embodiment of lavatory system 10 shown in FIG. 9 includes a hand dryer 66 supported by countertop 20. Hand dryer 66 includes a housing having an upper portion, shown as top wall 68, a lower portion, shown as a bottom wall 70, a first side portion, shown as a left sidewall 72, and a second side portion, shown as a right sidewall 74. The inner surfaces of top wall 68, sidewall 72, sidewall 74 and the upper surface of bottom wall 70 define a chamber or cavity 76 configured to receive a user's hands during a drying operation. The front edges of top wall 68 and sidewalls 72 and 74 and the upper surface of bottom wall 70 define an opening 78 generally facing and generally parallel to the front edge of countertop 20. To use hand dryer 66, the user's hands are inserted through opening 78 into cavity 76. As shown in FIG. 9, the positioning of opening 78 may allow the user to move their hands from sink 16 into cavity 76 while maintaining the user's hands above countertop 20. This configuration limits or prevents water from falling onto the floor or onto the user's clothing, as the user moves from the sink to the hand dryer.

As shown in FIG. 9, top wall 68 and sidewalls 72 and 74 are formed of an integral piece of material, and bottom wall 70 is integrally formed with countertop 20. In other embodiments, the various walls of hand dryer 66 may be one or more separate pieces or sections assembled together and coupled to and supported from countertop 20, backsplash 22, platform 36, the wall adjacent sink 16, a separate pedestal, etc. Top wall 68 is positioned generally parallel to the generally horizontal plane defined by countertop 20 and has a slight convex curvature, and sidewalls 72 and 74 are substantially perpendicular to top wall 68 and extend between the countertop 20 and the left and right edges of top wall 68, respectively. In the embodiment shown, the upper surface of bottom wall 70 is slightly concave defining a recess that helps trap or contain water from a user's hands.

In the embodiment shown, the width of cavity 76 (i.e., the length of the axis of cavity 76 generally parallel to the front edge of countertop 20) is greater than the height of cavity 76 (i.e., the length of the axis of cavity 76 generally perpendicular to bottom wall 70). In various embodiments, the width of cavity 76 may be more than about twice the height of cavity 76. In other embodiments, the width of cavity 76 may be more than about three times the height of cavity 76 or more than about four times the height of cavity 76. The convex top wall, concave bottom wall, and the relative sizes of the width and height of cavity 76 are such that cavity 76 is configured to receive the user's hands in a generally horizontal position or orientation (i.e., with the palms of the hands facing either up or down and generally parallel to countertop 20 and with the finger tips pointing generally toward the rear edge of countertop 20). Further, the shape of cavity 76 may also be configured to receive the user's hands in an oblique position/orientation (i.e., with the palms of the hands positioned at an angle relative to countertop 20). The shape of cavity 76 may also provide for containment and drainage of water from the users hands. In one embodiment, the housing of hand dryer embodiments discussed herein is configured to receive the user's hands in a horizontal position without the user's hands contacting the inner surfaces of the cavity. The horizontal positioning of hands during drying provided by cavity 76 may be a natural, comfortable position for the user of hand dryer 66.

Hand dyer 66 includes one or more air outlets (e.g., ports, apertures, nozzles, etc.) positioned along the lower surface of top wall 68. In one embodiment, hand dryer 66 includes a plurality (e.g., 2, 3, 4, 5, 6, etc.) of air outlets along the lower surface of top wall 68. In one exemplary embodiment, the air outlets are aimed to direct blown air downward toward bottom wall 70 and rearward toward the rear edge of countertop 20. Hand dryer 66 includes a front wall 80 positioned along the front edge of countertop 20 in front of cavity 76. As shown, front wall 80 is positioned vertically below the top wall 68 and is integrally formed with countertop 20. Front wall 80 includes a section extending generally perpendicular to and above the upper surface of countertop 20. Hand dryer 66 includes one or more air outlets positioned along the inner, rearward facing surface of front wall 80. In one exemplary embodiment, hand dryer 66 includes a single air outlet positioned along the inner, rearward facing surface of front wall 80 that is aimed to direct blown air towards the rear edge of countertop 20. As can be seen in this embodiment, air outlets of top wall 68 are positioned higher (e.g., at a higher position relative to the vertical axis) than the air outlets of front wall 80. Further, air outlets of top wall 68 may be positioned rearward of the air outlets of front wall 80. For example, air outlets of top wall 68 are positioned between the rear edge of countertop 20 and front wall 80. In another embodiment, bottom wall 70 may include one or more air outlets positioned along its upward facing surface. In this embodiment, the air outlets of bottom wall 70 are spaced apart from and opposing the air outlets of top wall 68.

As shown in FIG. 9, front wall 80 extends vertically above countertop 20. Thus, front wall 80, in addition to providing a mounting surface for one or more air outlets, acts as a deflector shield by, at least partially, blocking or inhibiting water and air from traveling out of the cavity 76 back toward the front edge of countertop 20 and the user or adjacent hand washing stations.

With the user's hands positioned within cavity 76, the air from the air outlets of top wall 68 and front wall 80 is directed through cavity 76 in the directions indicated above. Thus, during drying, water and/or particulate removed from the user's hands is directed generally downward toward bottom wall 70 and rearward toward the rear edge of countertop 20 by the blown air. The positioning or aiming of the air outlets helps to direct and contain both the water from the user's hands and the blown air within cavity 76. Hand dryer 66 includes one or more exhaust ports 82 positioned within cavity 76 that leads to an exhaust chamber. In the embodiment shown, exhaust ports 82 are shown positioned through bottom wall 70. Exhaust ports 82 provide an inlet to receive water and blown air facilitating the removal of water and blown air from cavity 76. In various embodiments discussed herein, the exhaust chamber may be exposed to a vacuum the help draw water and blow air into the exhaust chamber through exhaust ports 82.

In the embodiment shown in FIG. 9, hand dryer 66 includes a section 84 (e.g., arm, bridge, etc.) extending between the rear edge of top wall 68 and the front edge of platform 36 to provide support for top wall 68 and sidewalls 72 and 74. In one embodiment, section 84 acts as a housing for one or more air ducts carrying the air from the blower fan to the air outlets of top wall 68. In another embodiment, one or more air ducts carrying air from the blower fan to the air outlets of top wall 68 are located within sidewalls 72 and/or 74.

According to an exemplary embodiment, the hand dryer increases the air volume delivered to the hands using one or more slots 83 (e.g., apertures, holes, openings, etc.). Slots 83 act as nozzles and are shaped (e.g., choked) to provide the desired balance of pressure, velocity, and volume of air to cavity 76. Slots 83 may be shaped having a cross-sectional area that varies along the length of the slot in manner to control air flow into cavity 76. Slots 83 are located in top wall 68. Alternatively, the slots may be located in any of a variety of locations on the hand dryer or countertop. The air moving through the air duct draws outside air to increase the overall air volume delivered from the air outlets to the user's hands. Although shown in the embodiment of FIG. 9, the slots may be provided in any of the embodiments described herein.

The embodiment of lavatory system 10 shown in FIG. 10 includes a hand dryer 90 supported by countertop 20. Hand dryer 90 includes a housing including an upper portion, shown as top wall 92, a lower portion, shown as a bottom wall 94, and a first side portion, shown as a right sidewall 96. The inner surfaces of top wall 92 and sidewall 96, and the upper surface of bottom wall 94 define a chamber or cavity 98 configured to receive a user's hands during a drying operation. Hand dryer 90 includes a front portion 100 positioned adjacent to the front edge of countertop 20 in front of cavity 98. The front edges of top wall 92 and sidewall 96 and the upper surface of front portion 100 and the upper surface of the portion of countertop 20 adjacent to cavity 98 define an opening 102. To use hand dryer 90, the user's hands are inserted through opening 102 into cavity 98. Opening 102 is positioned having a portion facing sink 16 such that the user may move their hands from sink 16, either laterally from left to right and/or from front to back through opening 102 and into cavity 98 of hand dryer 90 while maintaining their hands above countertop 20. This arrangement may provide convenient access to cavity 98 of hand dryer 90 while eliminating the potential for water to drop from the user's hands onto the lavatory floor or the user's clothes.

As shown in FIG. 10, top wall 92 and sidewall 96 are integral with backsplash 22 and shelf 36, and bottom wall 94 is integrally formed with countertop 20. In other embodiments, the various walls of hand dryer 90 may be one or more separate pieces or sections assembled together and coupled to countertop 20, backsplash 22, platform 36, the wall adjacent sink 16, a separate pedestal, etc. Top wall 92 is a generally planar section extending in a generally horizontal direction from shelf 36. The front edge of top wall 92 is continuously curved having a first segment 104 that is generally perpendicular to the front edge of countertop 20, a second segment 106 that is generally parallel to the front edge of countertop 20, and a curved third segment 108 that extends from first segment 104 toward the right side of the lavatory system and then curves toward the front edge of countertop 20 to join with second segment 106.

As shown in FIG. 10, cavity 98 is configured to receive the user's hands in a generally horizontal position and provide for containment and drainage of water from the user's hands. Similar to the embodiment shown in FIG. 9, the horizontal positioning of hands during drying provided by cavity 98 may be a natural, comfortable position for the user of hand dryer 90. Further, bottom wall 94 is recessed below the upper face of countertop 20 to define a reservoir 110. As shown in FIG. 10, reservoir 110 is in fluid communication with sink 16 and drain 18 such that water that drips or is blown from a user's hands located within cavity 98 is allowed to flow from reservoir 110 into sink 16 and to drain 18. Sidewall 96 acts to further contain water and air within cavity 98 by inhibiting or preventing water and air from exiting the right side of cavity 98.

Hand dyer 90 includes one or more air outlets (e.g., ports, apertures, nozzles, etc.) positioned along the lower surface of top wall 92. In one embodiment, hand dryer 90 includes a plurality of (e.g., 2, 3, 4, 5, 6, etc.) air outlets along the lower surface of top wall 92. In one exemplary embodiment, the air outlets of top wall 92 are aimed to direct blown air downward toward bottom wall 94 and rearward toward the rear edge of countertop 20. Front portion 100 is positioned along the front edge of countertop 20 in front of cavity 98. As shown, front portion 100 is positioned vertically lower than top wall 92 and may be a separate piece mounted to countertop 20. In another embodiment, front portion 100 may be integrally formed with countertop 20. Hand dryer 90 includes one or more air outlets positioned along the inner, rearward facing surface of front portion 100. In one exemplary embodiment, hand dryer 90 includes a single air outlet positioned along the inner, rearward facing surface of front portion 100 that is aimed to direct blown air towards the rear edge of countertop 20. As can be seen in this embodiment, air outlets of top wall 92 are positioned higher (e.g., at a higher position relative to the vertical axis) than the air outlets of front portion 100. Further, air outlets of top wall 92 are positioned rearward of the air outlets of front portion 100 (e.g., between the rear edge of countertop 20 and front portion 100). As shown, front portion 100 is raised from or extends vertically above the outer surface of countertop 20. Thus, in addition to providing a mounting surface for one or more air outlets, front portion 100 acts as a deflector shield by, at least partially, blocking or inhibiting water and particulates and air from traveling out of the cavity 98 back toward the front edge of countertop 20 and the user.

With the user's hands positioned within cavity 98, the air from the air outlets of top wall 92 and front portion 100 is directed within cavity 98 in the directions indicated above. Thus, during drying, water and particulates removed from the user's hands are directed generally downward toward bottom wall 94 and rearward toward the rear edge of countertop 20 by the blown air. Thus, the positioning or aiming of the air outlets helps to direct and contain both the water and particulates from the user's hands and the blown air within cavity 98. Water and particulates that leave the user's hands are received within reservoir 110 and are permitted to flow through reservoir 110 to drain 18. In various embodiments, hand dryer 90 may include one or more exhaust ports within cavity 98 that lead to an exhaust chamber. The exhaust ports may provide an inlet to receive water and particulates and blown air facilitating the removal of water and particulates and blown air from cavity 98. In one embodiment, one or more exhaust ports are located along the inner surface of sidewall 96.

The embodiment of lavatory system 10 shown in FIG. 11 includes a hand dryer 120 supported by countertop 20. Hand dryer 120 includes a housing including an upper portion, shown as top wall 122, a first side portion, shown as a left sidewall 124, a central portion, shown as a center wall 126, and a second side portion, shown as right sidewall 128. The inner surfaces of top wall 122, left sidewall 124, right sidewall 128 and the upper surface of the bottom wall (recessed below the upper surface of countertop 20) define a chamber or cavity 130 configured to receive a user's hands during a drying operation.

In the embodiment of FIG. 11, cavity 130 is subdivided into a left hand cavity 132 configured to receive the user's left hand during a drying operation and a right hand cavity 134 configured to receive the user's right hand during a drying operation. Left hand cavity 132 is defined by the inner or right facing surface of sidewall 124 and by the left facing surface of center wall 126. Right hand cavity 134 is defined by the inner or left facing surface of sidewall 128 and by the right facing surface of center wall 126. Thus, in the embodiment of FIG. 11, hand dyer 120 includes separate or individual chambers for drying each of the user's hands. The front edges of left sidewall 124 and center wall 126 define a left opening 136, and the front edges of right sidewall 128 and center wall 126 define a right opening 138.

Openings 136 and 138 are generally facing the front edge of countertop 20. To use hand dryer 120, the user's left hand is inserted through opening 136 into left hand cavity 132, and the user's right hand is inserted through opening 138 into right hand cavity 134. As shown in FIG. 11, the positioning of openings 136 and 138 may allow the user to move their hands from sink 16 into cavities 132 and 134 while maintaining their hands above countertop 20. This configuration limits or prevents water from falling onto the floor or onto the user's clothing, as the user moves from the sink to the hand dryer. Further, hand dryer 120 includes a bottom wall that is recessed below the upper face of countertop 20 to define a reservoir 140. Reservoir 140 is in fluid communication with drain 18 such that water that drips or is blown from a user's hands is allowed to flow from reservoir 140 to drain 18.

As shown in FIG. 11, left sidewall 124, center wall 126 and right sidewall 128 are integrally formed with countertop 20, and top wall 122 extends from shelf 36 and is positioned generally parallel to the generally horizontal plane defined by the upper surface of countertop 20. In other embodiments, the various walls of hand dryer 120 may be one or more separate pieces or sections assembled together and coupled to and supported from countertop 20, backsplash 22, platform 36, the wall adjacent sink 16, a separate pedestal, etc. In the embodiment shown in FIG. 11, left sidewall 124, center wall 126 and right sidewall 128 are generally disc shaped portions that are positioned substantially perpendicular to the generally horizontal plane defined by the upper surface of countertop 20.

As shown, the heights of left hand cavity 132 and right hand cavity 134 (i.e., the lengths of axis of each cavity 132 and 134 generally perpendicular to countertop 20) are greater than the widths of left hand cavity 132 and right hand cavity 134 (i.e., the lengths of the axis of each cavity 132 and 134 generally parallel to the front edge of countertop 20). Thus, left hand cavity 132 and right hand cavity 134 are generally shaped to receive the user's hands in a generally vertical position (i.e., with the palms of the hands typically facing center wall 126 and generally perpendicular to countertop 20 and with the finger tips pointing generally toward the rear edge of countertop 20) and provide for containment and drainage of water and particulates from the users hands. The vertical positioning of hands during drying provided by cavities 132 and 134 may be a natural, comfortable position for the user of hand dryer 120. Because a user's hands may be placed in a plurality of vertical positions within cavities 132 and 134, the vertical orientation of cavities 132 and 134 may allow hand dryer 120 to be conveniently used by user's of various heights. In other embodiments, left sidewall 124, center wall 126 and right sidewall 128 may be other shapes (e.g., ovals, rectangles, etc.) and may be positioned at other angles relative to the horizontal plane. In one embodiment, the housing of hand dryer embodiments discussed herein is configured to receive the user's hands in a vertical position without the user's hands contacting the inner surfaces of the cavity.

As shown in FIG. 11, left sidewall 124, center wall 126 and right sidewall 128 each include a generally horizontal section, shown as a top shield 142, top shield 146 and top shield 148, that extends from at least a portion of the outer edges of left sidewall 124, center wall 126 and right sidewall 128. In this embodiment, the lower surfaces of top shield 142, top shield 146 and top shield 148, partially define the upper bounds of left hand cavity 132 and right hand cavity 134. As can be seen, top shield 142, top shield 146 and top shield 148 act to contain water and particulates and air within left hand cavity 132 and right hand cavity 134 by at least partially blocking or inhibiting water and particulates and air from exiting the cavities.

In one embodiment, hand dyer 120 includes one or more air outlets (e.g., ports, apertures, nozzles, etc.) positioned along the lower surface of top wall 122. In one exemplary embodiment, the air outlets of top wall 122 are aimed to direct blown air downward toward bottom of reservoir 140 and rearward toward the rear edge of countertop 20. In another embodiment, top wall 122 does not include air outlets and functions as a shield inhibiting water and air from exiting cavity 130 in the vertical direction.

In the embodiment shown in FIG. 11, air outlets are positioned on left sidewall 124, center wall 126 and right sidewall 128 such that air within cavities 132 and 134 is directed toward both sides of the user's vertically positioned hands. For example, to supply drying air to left hand cavity 132, left sidewall 124 includes one or more air outlets positioned along the inner, right facing surface of sidewall 124, and the left facing surface of center wall 126 includes one or more, separated, opposing air outlets 150. To supply drying air to right hand cavity 134, the right facing surface of center wall 126 includes one or more air outlets, and the inner, left facing surface of sidewall 128 includes one or more, separated, opposing air outlets 152. Thus, as can be seen, this arrangement provides for air to be directed to both the left and right sides of each of the user's hands during a drying operation. In one embodiment, hand dryer 120 includes a plurality (e.g., 2, 3, 4, 5, 6, etc.) of air outlets positioned along each of the surfaces of left sidewall 124, center wall 126 and right sidewall 128. In one exemplary embodiment, the air outlets of left sidewall 124, center wall 126 and right sidewall 128 are aimed to direct blown air downward toward bottom of reservoir 140 and rearward toward the rear edge of countertop 20.

With the user's hands positioned within cavities 132 and 134, the air from the air outlets of hand dryer 120 is directed through cavities 132 and 134 in the directions indicated above. Thus, during drying, water removed from the user's hands is directed generally downward toward the bottom of reservoir 140 and rearward toward the rear edge of countertop 20 by the blown air. Thus, the positioning or aiming of the air outlets helps to direct and contain both the water from the user's hands and the blown air within cavities 132 and 134. As noted above, water that leaves the user's hands is received within reservoir 140 and is permitted to flow through reservoir 140 to drain 18.

Hand dryers 66, 90 and 120 shown in FIGS. 9 through 11 may include one or more sensors that detect the presence of the user's hands to control activation/deactivation of the hand dryers. In various embodiments, when the sensors associated with hand dryers 66, 90 and 120 detect that a user's hands are in the appropriate position with in the drying cavities, the blower fan(s) for each hand dryer is activated such that blown air is delivered to the cavities via the air outlets to dry the user's hands. In one embodiment, the sensors associated with the hand dryers are configured and/or positioned such that the blower fan or air handling device for the hand dryer is activated when the user's hands are fully inserted into the cavity of the hand dryer. In another embodiment, the sensors associated with the hand dryers are configured and/or positioned such that the speed of the air delivered by the blower fan increases as the user's hands move further into the cavity of the hand dryer.

In one embodiment shown in FIG. 14 and as discussed above, lavatory system 10 may include a control system 180 and a controller 182. In these embodiments, lavatory system 10 includes at least a first sensor 184 and a second sensor 186 associated with a hand dryer, such as hand dryers 26 66, 90 and 120, and a third sensor 188 associated with a hand washing fixture, such as hand washing fixture 24. As shown in the embodiment of FIG. 14, the sensors 184, 186, 188 are in communication with controller 182 such that output signals from the sensors can be communicated from the sensors to controller 182 (e.g., the sensors are wired to the controller, the sensors are configured for wireless communication with the controller, etc). Controller 182 is also in communication with the controlled fixtures (e.g., hand washing fixture 24, hand dryer 26, etc.) or with components of the controlled fixture (e.g., an electronically controlled valve of hand washing fixture 24, a control circuit for hand dryer 26, a power supply element for hand dryer 26, etc.) such that control signals may be communicated from controller 182 to each of the controlled fixtures. The control signals from controller 182 are received by each of the fixtures, and each fixture is operated based on the received control signal.

It should be understood that receiving control signals at the fixture or hand dryer can include receiving control signals at control circuits, power supplies, electronically controlled valves, timers, switches, logic elements, or other control devices associated with the hand washing fixture or hand dryer. In some embodiments, the control signals may be received directly from the sensors and a distributed collection of switches or logic circuitry for hand washing fixtures, hand dryer, and/or the sensors can be considered the controller or control system. Alternatively, one of the controller for the hand washing fixture or the controller for the hand dryer may serve as the master controller relative to the other controller. For example, the controller for the hand washing fixture may include hand detection logic and allow or restrict power to the hand dryer blower (via a control signal, via a switch that disconnects power, etc.). In another embodiment, the hand dryer includes its own hand detection logic, but the on/off decisions are conducted by a controller of the hand washing fixture. In yet other embodiments, the hand washing fixture controller may receive a status signal (e.g., on, off) from the hand dryer and may include logic that will not allow an electronically controlled valve of the hand washing fixture to open when the status signal from the hand dryer indicates that the hand dryer is active. In another example, the hand dryer may include a master controller that primarily controls the activation or deactivation activity for both the hand dryer and the hand washing fixture.

In one embodiment, lavatory system 10 includes a first sensor that is located toward the rear of the drying cavity, shown as rear hand dryer sensor 184, and a second sensor that is located toward the front of the drying cavity, shown as front hand dryer sensor 186. In one embodiment, front hand dryer sensor is positioned near either the front or lateral entrance of the hand drying cavity. Lavatory system 10 may also include a hand washing fixture sensor 188 that detects the user's hands adjacent to fixture 24. In response to a signal from hand washing fixture sensor 188 representing the detection of the user's hands adjacent to hand washing fixture 24, the controller 182 activates (e.g., causes the activation of, triggers, initiates, etc.) the flow of water, soap, or other hand washing fluid from fixture 24. In one embodiment, rear hand dryer sensor 184 detects when the user's hands have been fully inserted into the cavity. In response to a signal from rear hand dryer sensor 184 representing the detection of the user's hands fully inserted into the cavity, the controller 182 activates the blower fan of the hand dryer. In this embodiment, front hand dryer sensor 186 detects the user's hands exiting the dryer cavity. In response to a signal from front hand dryer sensor 186 representing the detection of the user's hands exiting the dryer cavity, the controller 182 deactivates the blower fan (e.g., sends a 'shut off' signal to a controller of the blower fan, causes power to be removed from the blower fan, etc.). In one such embodiment, the controller 182 may cause the blower fan of the hand dryer to remain on, once activated, until front hand dryer sensor 186 detects that the user's hands have completely or nearly completely exited the drying cavity of the hand dryer.

In various embodiments, a variety of sensors may be used. For example, through-beam sensors, reflectivity sensors, position sensors, optical sensors, capacitive sensors, or any other sensors (or system of sensors) suitable for detecting the presence or absence of a human hand may be used in the lavatory system 10. It should be understood that detecting a user's hands can include completing sensor detections and outputs appropriate for the type of sensor or sensors used in the lavatory system 10. For example, if the sensor is a capacitive sensor, detecting a user's hands can be or include varying an output signal from the sensor in response to a detected capacitance change. In some embodiments, the controller 182 interprets varying output signals (e.g., analog, digital, etc.) from the sensor to determine whether one or more threshold conditions are met or exceeded. Such activities can all be considered detecting a user's hand using a lavatory control system.

Controller 182 may generally be an electronic control circuit or control unit suitable to provide lavatory system 10 with the various control functionalities discussed herein. Controller 182 may be hardwired, programmed, or both. Controller 182 may be an embedded system, a dedicated circuit, or a general purpose system programmed with the functionality described herein. Controller 182 may include a processing circuit (e.g., a general purpose processor, an application specific processor, etc.) configured to provide the control lavatory system 10 as described in the present application. Controller 182 may include memory (e.g., memory unit, memory device, storage device, etc.) which may be one or more devices for storing data and/or computer code for completing and/or facilitating the various functions discussed herein. The memory may include volatile memory and/or non-volatile memory. Controller 182 may also include various communication links and communication interfaces for providing communication between the sensors, fixtures and the controller of lavatory system 10. The communication interface may include one or more jacks or other hardware for physically coupling the sensors and fixtures to controller 182, an analog to digital converter, a digital to analog converter, signal processing circuitry, a transmitter, a receiver, and/or any other suitable components for effecting the communication described in the present application. Communication interface may include hardware configured to connect controller 182 with the sensors and fixtures of lavatory system 10 via wireless connections.

Each of the lavatory system embodiments shown in FIGS. 9 through 11 may include any combination of features of the embodiments shown in FIGS. 1 through 8G. In particular, each of the lavatory system embodiments shown in FIGS. 9 through 11 may include a shared drain between the hand dryer and drain 18 of sink 16. For example, each of the lavatory system embodiments of FIGS. 9 through 11 may include a conduit 46 joining a hand dryer drain to drain 18. Further, the hand dryers shown in FIGS. 9 through 11 may include one or more blower fans, a fan housing, such as lower housing 48, and one or more air ducts, such as air ducts 50 and 52 or air manifolds, as discussed above. Also, any of the embodiments described herein may provide a vacuum to help draw water and particulates in to the drain and/or exhaust chamber. According to an exemplary embodiment, a UV (ultraviolet) light source may be provided (e.g., to the air intake portion) of any of the hand dryers described herein. The UV light is intended to treat (e.g., disinfect, sterilize, sanitize, clean, filter, scrub, etc.) the air blown on to the user's hands. Alternatively, a filter (e.g., HEPA filter) may be used.

In one embodiment, air delivered from the air outlets is a high speed, high pressure air flow that pushes, scrapes, or wipes water or particulate from the user's hands, as opposed to primarily drying the user's hands via evaporation. The air outlets of the various hand dryer embodiments are configured to generate a sheet, wall, or series of columns of high velocity air. To dry ones hands, the user's hands are moved through the sheet, wall, or series of columns of high velocity air and the wall of high velocity air scrapes (e.g., wipes, moves, pushes, etc.) the water from the user's hands. In other embodiments, the hand dryer embodiments discussed herein may deliver heated air that dries the user's hands via a combination of evaporation and physical removal of water from the user's hands. Air is directed at an oblique angle relative to the user's skin so that any materials discharged from the user's skin is directed into the containment cavities or drainage.

According to an exemplary embodiment, one or more of fixtures of lavatory system 10 (e.g., hand washing fixtures 24, hand dryer 26, etc.) may be powered by a photovoltaic cell and a power management system such as disclosed in U.S. patent application Ser. No. 11/041,882 titled "Lavatory System" filed Jan. 21, 2005, which is hereby incorporated herein by reference in its entirety. According to another exemplary embodiments, one or more of the fixtures on lavatory system 10 (e.g., hand washing fixtures 24, hand dryer 26, etc.) may be powered by another energy efficient device such as a paddle wheel. According to still another exemplary embodiment, one or more of the fixtures on lavatory system 10 (e.g., hand washing fixtures 24, hand dryer 26, etc.) may be powered by an AC power line, or DC power switching supply.

In the various embodiments discussed herein, the hand dryers may be configured to deliver pulsed air (e.g., air that is delivered in a series of bursts) from the air outlets instead of delivering steady, continuous streams of air during drying. In various embodiments, using pulsed air may provide for sufficient or superior drying performance, may be more comfortable to the user and may also provide for reduction in energy consumption during the drying process.

Figure 12:
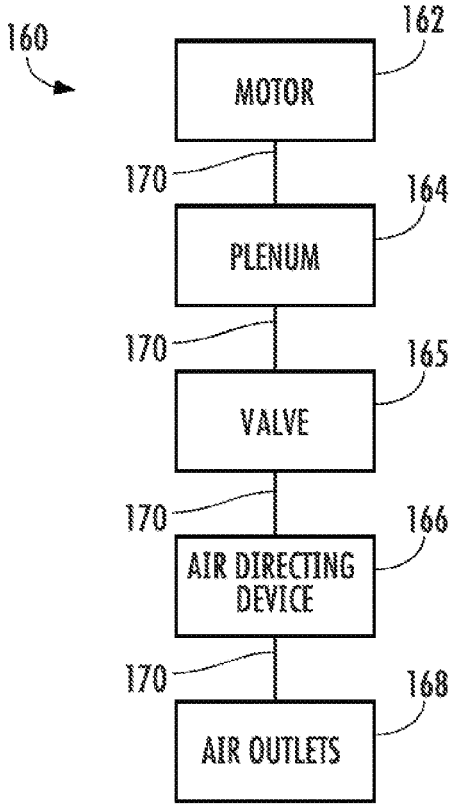
FIG. 12 is a block diagram of a hand dryer according to an exemplary embodiment.
Figure 13:
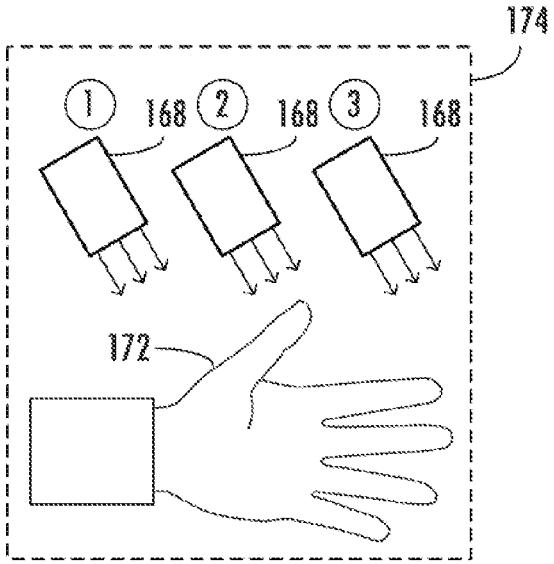
FIG. 13 is a schematic diagram showing the use of the hand dryer of FIG. 12 according to an exemplary embodiment.

Referring to FIGS. 12 and 13, a hand dryer 160 configured to deliver pulsed air is shown according to an exemplary embodiment. Hand dryer 160 includes a motor 162, a pressure tank or plenum 164, a valve device 165, an air directing device 166, and one or more air outlets 168. The various components of hand dryer 160 are connected via conduits or air ducts 170 such that air may be communicated between the various components, as discussed below. In operation, motor 162 operates to move air into plenum 164. As motor 162 fills plenum 164 with air, the pressure within plenum 164 increases. Motor 162 runs until the pressure within plenum 164 reaches a threshold (e.g., a maximum allowable pressure, a minimum allowable threshold, etc.). Plenum 164 acts to store pressurized air until the air is to be delivered via air outlets 168 to a hand dryer cavity for a drying operation.

When hand dryer 160 is activated (e.g., via sensors, as discussed above, via activation of a switch or button, etc.), valve device 165 is briefly opened allowing a pulse of pressurized air to be released from plenum 164 and into air directing device 166. Air directing device 166 directs the released pulse of air through the appropriate conduits to one or more of air outlets 168. Air outlets 168 direct the air toward the user's hands within the cavity of the hand dryer to remove water for the user's hands. The lavatory system equipped with hand dryer 160 may include a control system having a control circuit (e.g., a processor, etc.) that controls the various components of hand dryer 160 to deliver pulsed air as discussed herein.

In one embodiment, as shown in the schematic diagram of FIG. 13, hand dryer 160 may be configured to deliver pulsed air through the multiple air outlets 168 in a predetermined series or sequence. As shown in FIG. 13, with a user's hand 172 located within a drying cavity 174 of hand dryer 160, hand dyer 160 is activated, and a first pulse of air is released from plenum 164 by the opening of valve 165. Air directing device 166 directs the first released pulse of air to one of the air outlets 168, and the air outlet 168 directs or aims the air toward the user's hand for drying. Next, a second pulse of air is released from plenum 164 by the opening of valve 165. Air directing device 166 directs the second released pulse of air to one of the air outlets 168, and the air outlet 168 directs the air toward the user's hand for drying. Air is released from plenum 164 as discussed above such that pulses of air are delivered to each air outlet 168 in the predetermined sequence for the particular drying operation.

As shown schematically in the exemplary embodiment of FIG. 13, pulsed air may be directed to air outlets 168 by air directing device 166 such that pulsed air is delivered sequentially along the length of the user's hand from wrist to the finger tips (or from the forearm to the fingertips). For example in FIG. 13, a first burst of air may be delivered via the left most air outlet 168, then a second burst of air is delivered via the center most air outlet 168, and then a third burst of air is delivered to the right most air outlet 168. In this manner, water may be blown or scraped from the user's hands 172 by the sequential delivery of pulsed air from wrist to finger tip without requiring the user to move their hands within cavity 174. In another embodiment, each released pulse of air may be directed through more than one air outlet 168 at once in a predetermined sequence or pattern. In another embodiment, the released pulses of air may be directed through air outlets 168 in any of a variety of sequences or combinations of pulses, and, in another embodiment, the released pulses of air may be delivered through all of the air outlets 168 of hand dyer 160 at once.

Air directing device 166 may be any device or combinations of devices to direct air to the appropriate air outlets 168 of hand dryer 160. For example, in one embodiment, air directing device 166 may include a dedicated conduit for each air outlet 168 and a dedicated valve that releases air from plenum 164 into the conduit to be delivered to the appropriate air outlet 168 in the sequence. In one such embodiment, the dedicated valve for each air outlet may be a timed solenoid valve that is opened to deliver pulsed air to each air outlet in the appropriate sequence. In other embodiments, air directing device 166 may be a single device or valve that sequentially delivers air to the appropriate air outlets in the sequence. For example, in various embodiments, air directing device 166 may be a rotating piston valve or may be a multi-valve with a rotating cylindrical piston.

In various embodiments, plenum 164 may be sized to store sufficient pressurized air to deliver pulsed air for multiple drying operations. In this embodiment, motor 162 is activated to refill plenum 164 when the pressure within plenum 164 falls below a certain threshold. In another embodiment, plenum 164 may be sized to store sufficient pressurized air to deliver pulsed air for multiple drying operations, and motor 162 is activated to refill plenum 164 following each drying operation. In yet another embodiment, plenum 164 may be sized to store pressurized air for a single drying operation, and, in this embodiment, motor 162 is activated to refill plenum 164 following each drying operation. Using plenum 164 to deliver pulsed air may allow hand dryer 160 to be constructed with a motor 162 that is smaller (e.g., lower power, etc.) than may needed to deliver pulsed air directly from the motor to air outlets 168. Further, because a lower power motor may be used to fill plenum 164 as required, in some embodiments, hand dryer 160 may consume less energy than a hand dryer that delivers pulsed air directly from the motor.

It is to be understood that the inventions disclosed herein are not limited to the details of construction and the arrangement of the components set forth in the description or illustrated in the drawings. The inventions are capable of other embodiments or being practiced or carried out in various ways. It is also to be understood that the phraseology and terminology employed herein is for the purpose of description and should not be regarded as limiting.

Also, the particular materials used to construct the exemplary embodiments are also illustrative. For example, the countertop, sink, hand dryer, etc. may be made from any of a variety of solid surface materials, stainless steel, laminates, fiberglass, engineered stone, natural quartz, quartz surfacing materials, and the like. According to an exemplary embodiment, the countertop is made from a densified solid surface material composed of an acrylic modified polyester resin, and/or other applicable regulations or standards. The upper housing of the hand dryer may be formed of the same material to substantially match the countertop and/or sink. The surface material may be of a type commercially available under the trade name TERREON® or EVERO™ from Bradley Corporation of Menomonee Falls, Wis.

Also, the terms are intended to be broad terms and not terms of limitation. These components may be used with any of a variety of hand washing locations and are not intended to be limited to use with washroom or restroom applications. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the lavatory system as shown in the exemplary embodiments are illustrative only. While the current application recites particular combinations of features in the claims appended hereto, various embodiments of the invention relate to any combination of any of the features described herein whether or not such combination is currently claimed, and any such combination of features may be claimed in this or future applications. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the disclosed embodiments. For example, various embodiments are shown as one or two wash stations, but it should be understood that these are shown as examples and the invention is applicable to any of a variety of wash station configurations (e.g., one, two, three, four, etc. stations). Accordingly, all such modifications are intended to be included within the scope of the present inventions as defined in the disclosed embodiments. The order or sequence of any process or method steps may be varied or re-sequenced according to alternative embodiments. In the disclosed embodiments, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present inventions.

What is claimed is:

1. A lavatory system comprising;

a countertop cantilevered from the lavatory system forming a generally planar surface;

a first hand washing station, the first hand washing station comprising:

a basin supported in a central portion of the countertop;

a faucet extending from the lavatory system and cantilevered above the basin configured to dispense a liquid water into the basin; and a hand dryer comprising:

a housing extending from the lavatory system, at least a portion thereof cantilevered above the basin, the housing defining a cavity in which a user's hands are inserted during drying, wherein the housing is located such that the user's hands may be inserted into the cavity without the user leaving the first hand washing station;

a motor configured to generate blown air which is supplied to the cavity;

a first air outlet in the housing configured to direct blown air towards the user's hands within the cavity;

a second air outlet in a front portion in the basin below the first air outlet in the basin configured to direct blown air toward the user's hands within the cavity; and wherein the cavity is formed between the first and second air outlets and the first and second air outlets are positioned to direct blown air towards opposite sides of the user's hands when inserted within the cavity.

2. The lavatory system of claim 1, further comprising a first drain in fluid communication with the basin, wherein the hand dryer includes a reservoir configured to collect water removed from the user's hands, the reservoir in fluid communication with the first drain.

3. The lavatory system of claim 2, wherein the reservoir is in fluid communication with the basin such that water collected within the reservoir is permitted to flow from the reservoir into the basin and into the first drain.

4. The lavatory system of claim 3, wherein the countertop includes a first recessed portion defining the basin and a second recessed portion defining the reservoir, wherein the reservoir is sloped towards the basin, wherein the cavity is positioned above the reservoir.

5. The lavatory system of claim 4, wherein the first recessed portion is integral with the second recessed portion.

6. The lavatory system of claim 1, wherein at least a portion of the housing is integral with the countertop.

7. The lavatory system of claim 1, wherein both the first and second air outlets are positioned to direct blown air towards the rear of the cavity.

8. The lavatory system of claim 1, wherein the housing is shaped such that the cavity is configured to receive the user's hands in an orientation wherein the user's fingers are pointed substantially toward the rear of the cavity.

9. The lavatory system of claim 1, wherein the housing is shaped such that the cavity is configured to receive the user's hands in a horizontal orientation.

10. The lavatory system of claim of claim 1, wherein the first air outlet is positioned to direct air downward towards the user's hands and the second air outlet is positioned to direct blown air upward towards the user's hands, wherein both the first and second air outlets are positioned to direct blown air towards the rear of the cavity.

11. The lavatory system of claim 10, wherein the housing comprises a top wall, wherein the first air outlet is positioned along a lower surface of the top wall.

12. The lavatory system of claim 1, wherein the housing defines a first cavity entrance generally facing the basin such that the user's hands may be moved laterally from the basin through the first cavity entrance and into the cavity.

13. The lavatory system of claim of claim 12, wherein the housing further comprises a sidewall positioned on a side of the cavity opposite the first cavity entrance, wherein the sidewall blocks at least a portion of water or blown air from exiting the cavity in a direction opposite of the first cavity entrance.

14. The lavatory system of claim 1, wherein the hand dryer is an electric hand dryer and the motor is an electric motor.

15. The lavatory system of claim 1, further comprising a control system configured to control operation of the faucet and the hand dryer.

16. The lavatory system of claim 15, further comprising a first sensor associated with the faucet and a second sensor associated with the hand dryer, wherein the first sensor detects the presence of the user's hands adjacent the faucet and the second sensor detects the presence of the user's hands within the cavity of the hand dryer, wherein the control system is configured to activate the faucet in response to the first sensor detecting the presence of the user's hands adjacent the faucet, wherein the control system is configured to activate the hand dryer in response to the second sensor detecting the presence of the user's hands within the cavity of the hand dryer.

17. The lavatory system of claim 16, wherein the control system is configured to deactivate the faucet in response to at least one of (a) activation of the hand dryer and (b) the second sensor detecting the presence of the user's hands within the cavity of the hand dryer.

18. A lavatory system comprising:

a countertop extending horizontally from the lavatory system forming a generally planar surface;

a first hand washing station, the first hand washing station comprising:

a basin supported by the countertop;

a faucet extending from the lavatory system above the basin configured to dispense a liquid water into the basin; and a hand dryer comprising:

a housing extending from the lavatory system above the basin, the housing defining a cavity between the basin and the housing in which a user's hands are inserted during drying, wherein the housing is located such that the user's hands may be inserted into the cavity without the user leaving the first hand washing station;

a motor configured to generate blown air which is supplied to the cavity; and a first air outlet in the housing and a second air outlet in a front portion in the basin below the first air outlet.

19. A lavatory system comprising;

a countertop cantilevered from the lavatory system forming a generally planar surface;

a first hand washing station, the first hand washing station comprising:

a basin supported in a central portion of the countertop;

a faucet extending from the lavatory system and cantilevered above the basin configured to dispense a liquid water into the basin; and a hand dryer comprising:

a housing extending from the lavatory system, at least a portion thereof cantilevered above the basin, the housing defining a cavity in which a user's hands are inserted during drying, wherein the housing is located such that the user's hands may be inserted into the cavity without the user leaving the first hand washing station;

a first air outlet in the housing and a second air outlet in a front portion in the basin below the first air outlet;

a motor configured to generate blown air which is supplied to the cavity;

a first sensor associated with the faucet, wherein the first sensor detects the presence of the user's hands adjacent the faucet;

a second sensor associated with the hand dryer, wherein the second sensor detects the presence of the user's hands within the cavity of the hand dryer and is located toward the rear of the cavity and detects when the user's hands are fully inserted into the cavity;

a third sensor associated with the hand dryer, wherein the third sensor is located near an entrance of the cavity configured to detect the user's hands exiting the cavity; and a control system configured to control operation of the faucet and the hand dryer, wherein the control system is configured to:

activate the faucet in response to the first sensor detecting the presence of the user's hands adjacent the faucet;

activate the hand dryer in response to the second sensor detecting the presence of the user's hands within the cavity of the hand dryer; and deactivate the hand dryer in response to the third sensor detecting the user's hands exiting the cavity.

20. A lavatory system comprising:

a basin extending horizontally from the lavatory system configured to collect a liquid water;

a faucet extending from the lavatory system and cantilevered above the basin configured to dispense a liquid water into the basin; and a hand dryer comprising;

a housing coupled to the lavatory system, the housing defining a cavity between a first air outlet above the basin and a second air outlet in a front portion in the basin below the first air outlet in which a user's hands are inserted during drying;

a device configured to generate moving air which is supplied to the first air outlet and the second air outlet;

wherein the first air outlet is positioned to direct moving air downward and rearward towards the user's hands within the cavity; and wherein the second air outlet is positioned within the cavity to direct moving air upward and rearward towards the user's hands in the cavity.

21. The lavatory system of claim 20, wherein the housing is shaped such that the cavity is configured to receive the user's hands in a horizontal position.

22. The lavatory system of claim 20, wherein the housing defines a first cavity entrance generally facing the basin and a second cavity entrance positioned to generally face the user.

23. The lavatory system of claim 22, wherein a horizontal dimension of the second cavity entrance is greater than a vertical dimension of the second cavity entrance.

24. The lavatory system of claim 23, further comprising a countertop, the countertop coupling the housing of the hand dryer to the basin, the countertop having a front edge, wherein the horizontal dimension of the second cavity entrance is substantially parallel to the front edge of the basin, wherein the second cavity entrance generally faces the front edge of the countertop.

25. The lavatory system of claim 24, wherein at least a portion of the housing of the hand dryer and at least a portion of the basin are integral with the countertop.

26. The lavatory system of claim 20, wherein the housing comprises a top wall, wherein the first air outlet is positioned along a surface of the top wall and the second air outlet is located below the first air outlet.

27. The lavatory system of claim 26, wherein the top wall is substantially horizontal.

28. The lavatory system of claim 20, wherein the shortest distance between a rim of the basin and an entrance to the cavity is less than about three feet.

* * * * *